US010407904B2

(12) United States Patent
Gillette et al.

(10) Patent No.: US 10,407,904 B2
(45) Date of Patent: Sep. 10, 2019

(54) APPARATUS AND SYSTEM FOR DYNAMIC CEILING SYSTEM AND METHODS THEREOF

(71) Applicant: Turf Design, Inc., Elgin, IL (US)

(72) Inventors: Jason T. Gillette, Chicago, IL (US); Keith Alsberg, Evanston, IL (US); Scott H Wilson, Chicago, IL (US); David B Seal, Chicago, IL (US)

(73) Assignee: TURF DESIGN, INC., Elgin, IL (US)

( * ) Notice: Subject to any disclaimer, the term of this patent is extended or adjusted under 35 U.S.C. 154(b) by 0 days.

(21) Appl. No.: 16/006,547

(22) Filed: Jun. 12, 2018

(65) Prior Publication Data

US 2018/0363295 A1 Dec. 20, 2018

Related U.S. Application Data

(60) Provisional application No. 62/518,342, filed on Jun. 12, 2017.

(51) Int. Cl.
*E04B 9/24* (2006.01)

(52) U.S. Cl.
CPC ..... *E04B 9/248* (2013.01)

(58) Field of Classification Search
CPC ..... E04B 9/248; E04B 9/006; E04B 1/84
See application file for complete search history.

(56) References Cited

U.S. PATENT DOCUMENTS

| | | | | |
|---|---|---|---|---|
| 1,942,662 A | | 1/1934 | Rosenblatt | |
| 3,378,974 A | * | 4/1968 | Bush, Jr. | E04B 9/248 428/47 |
| 3,473,280 A | | 10/1969 | Stahlhut | |
| 3,522,923 A | * | 8/1970 | Charpentier | E04B 9/248 52/489.2 |
| 3,578,105 A | | 5/1971 | Griff | |
| 3,765,141 A | | 10/1973 | Shayman | |
| 3,969,870 A | | 7/1976 | Deaton | |

(Continued)

FOREIGN PATENT DOCUMENTS

EP 0606146 7/1994

OTHER PUBLICATIONS

Pinta Acoustic Inc., pinta acoustic introduces SONEX® PLANO Absorbers Customizable to add a distinctive flair with high sound absorption, pp. 1-4, Oct. 27, 2015, Pinta Acoustic Inc., https://www.pinta-acoustic.com/blog/2015/10/27/ sonex-plano-absorbers/.

(Continued)

*Primary Examiner* — Andrew J Triggs
(74) *Attorney, Agent, or Firm* — Patzik, Frank & Samotny Ltd.

(57) ABSTRACT

An acoustic ceiling tile and a dynamic acoustic ceiling system that includes multiple ceiling tiles that can be quickly and easily installed onto ceiling structures utilizing attached or embedded magnetic assemblies to provide an aesthetically pleasing image, such as an fluctuating image, along with a reduction in unwanted noise or room acoustics, wherein the attached or embedded magnetic assemblies are configured to be removed from the ceiling tile, and then configured to be easily placed or located onto a different location on the ceiling tile as needed, to allow for optimal installation of the ceiling tile onto the ceiling structure.

15 Claims, 21 Drawing Sheets

(56) References Cited

U.S. PATENT DOCUMENTS

| | | | | |
|---|---|---|---|---|
| 3,996,458 | A | 12/1976 | Jones et al. | |
| 4,200,171 | A | 4/1980 | Seymour et al. | |
| 4,228,867 | A | 10/1980 | Wirt | |
| 4,365,449 | A | 12/1982 | Liautaud | |
| 4,665,674 | A | 5/1987 | Brugman | |
| 5,292,282 | A * | 3/1994 | Callas | F24F 13/08 454/292 |
| 5,832,685 | A | 11/1998 | Hermanson | |
| 6,209,680 | B1 | 4/2001 | Perdue | |
| 8,733,053 | B2 | 5/2014 | Kabatsi et al. | |
| 8,782,987 | B2 | 7/2014 | Kabatsi et al. | |
| 9,163,402 | B2 | 10/2015 | Kabatsi et al. | |
| 9,175,473 | B2 * | 11/2015 | Kaump | E04B 9/0464 |
| 9,279,253 | B1 * | 3/2016 | Gaydos | E04B 9/34 |
| 9,353,521 | B2 | 5/2016 | Waters | |
| 9,410,317 | B1 | 8/2016 | Kilian et al. | |
| D767,171 | S | 9/2016 | Kilian et al. | |
| D767,816 | S | 9/2016 | Kilian et al. | |
| D771,279 | S | 11/2016 | Kilian et al. | |
| D771,280 | S | 11/2016 | Kilian et al. | |
| D771,281 | S | 11/2016 | Kilian et al. | |
| 9,506,249 | B2 | 11/2016 | Kabatsi et al. | |
| D777,349 | S | 1/2017 | Kilian et al. | |
| D777,943 | S | 1/2017 | Kilian et al. | |
| D777,944 | S | 1/2017 | Kilian et al. | |
| D777,945 | S | 1/2017 | Kilian et al. | |
| D777,946 | S | 1/2017 | Kilian et al. | |
| D777,951 | S | 1/2017 | Kilian et al. | |
| D781,464 | S | 3/2017 | Kilian et al. | |
| D783,182 | S | 4/2017 | Kilian et al. | |
| D783,183 | S | 4/2017 | Kilian et al. | |
| D783,184 | S | 4/2017 | Kilian et al. | |
| D784,562 | S | 4/2017 | Kilian et al. | |
| D784,563 | S | 4/2017 | Kilian et al. | |
| D784,564 | S | 4/2017 | Kilian et al. | |
| D784,565 | S | 4/2017 | Kilian et al. | |
| D785,212 | S | 4/2017 | Kilian et al. | |
| D791,979 | S | 7/2017 | Kilian et al. | |
| D791,980 | S | 7/2017 | Kilian et al. | |
| D791,981 | S | 7/2017 | Kilian et al. | |
| D792,986 | S | 7/2017 | Kilian et al. | |
| D794,222 | S | 8/2017 | Kilian et al. | |
| D794,223 | S | 8/2017 | Kilian et al. | |
| D794,224 | S | 8/2017 | Kilian et al. | |
| D794,836 | S | 8/2017 | Kilian et al. | |
| D795,466 | S | 8/2017 | Kilian et al. | |
| D802,173 | S | 11/2017 | Kilian et al. | |
| D802,174 | S | 11/2017 | Kilian et al. | |
| D821,613 | S | 6/2018 | Kilian et al. | |
| D840,551 | S | 2/2019 | Kilian et al. | |
| D846,160 | S | 4/2019 | Kilian et al. | |
| 2003/0205016 | A1 | 11/2003 | Gulbrandsen | |
| 2011/0078970 | A1 * | 4/2011 | Boyd | E04B 9/241 52/506.07 |
| 2016/0281353 | A1 | 9/2016 | Gillette | |
| 2018/0363295 | A1 * | 12/2018 | Gillette | E04B 9/248 |

OTHER PUBLICATIONS

Echojazz AG, EchoBaffle, single Facebook® post, single album, and two images from album, Jun. 26, 2015, Facebook®, https://www.facebook.com/echojazz.acoustic/.

Echojazz AG, EchoPanel® Fold-It Maxi by Gavin Harris, single Facebook® post, single album, and three images from album, Jun. 26, 2015, Facebook®, https://www.facebook.com/echojazz.acoustic/.

* cited by examiner

Acoustic Testing (ASTM C 423)

| FREQUENCY (Hz) | SOUND ABSORPTION COEFFICIENT |
|---|---|
| 32 | 0.3 |
| 40 | .01 |
| 50 | .02 |
| 63 | .07 |
| 80 | .06 |
| 100 | .09 |
| 125 | .12 |
| 160 | .20 |
| 200 | .24 |
| 250 | .33 |
| 315 | .45 |
| 400 | .59 |
| 500 | .76 |
| 630 | .65 |
| 800 | .89 |
| 1,000 | 1.00 |
| 1,250 | 1.06 |
| 1,600 | 1.06 |
| 2,000 | .99 |
| 2,500 | .89 |
| 3,150 | .83 |
| 4,000 | .94 |
| 5,000 | 1.04 |
| 6,300 | 1.00 |
| 8,000 | 1.05 |
| 10,000 | 1.07 |
| 12,500 | 1.07 |

98 102 104 106

FIG. 21

APPARATUS AND SYSTEM FOR DYNAMIC CEILING SYSTEM AND METHODS THEREOF

CROSS-REFERENCE TO RELATED APPLICATION

This application claims priority to U.S. provisional application No. 62/518,342, filed Jun. 12, 2017, entitled APPARATUS AND SYSTEM FOR DYNAMIC ACOUSTIC FLUCTUATING CEILING SYSTEM AND METHODS THEREOF, which is hereby incorporated by reference in its entirety as though fully set forth herein.

FIELD OF THE INVENTION

The instant disclosure relates to a ceiling product, a system for dynamic acoustic ceiling product, along with the methods for installing the ceiling product, and in particular, the instant disclosure relates to a dynamic acoustic ceiling system, that includes multiple ceiling tiles that can be quickly and easily installed onto a ceiling structure utilizing one or more attached or embedded magnetic assemblies to provide an aesthetically pleasing image, such as an fluctuating image, along with a reduction in unwanted noise and/or room acoustics.

The instant disclosure relates to attached or embedded magnetic assemblies that are configured to easily and securely attach at various locations on the ceiling tile, and then configured to be easily removed, as necessary, to be placed or located onto a different location on the ceiling tile as needed to allow for optimal installing or attaching the ceiling tile onto ceiling hangers. The attached or embedded magnetic assemblies can also be removed from the ceiling tile and reattached to the ceiling tile after the ceiling tile has been altered to avoid obstacles or impediments in the ceiling. The reattached magnetic assemblies allow for the altered or modified ceiling tile to be easily and securely attached to the ceiling structure.

The instant disclosure further relates to an apparatus that is configured using recycled polyester felt or PET Felt, and in an embodiment, providing for numerous different shapes that when installed in a repeating pattern, as detailed below, create a fluctuating effect or image. Each fluctuating ceiling tile is configured from a piece of PET Felt and contains one or more reusable magnetic assemblies, that allow for the fluctuating ceiling product to be installed into the drop ceiling hanger without any extra tools, clips or additional hardware.

BACKGROUND OF THE INVENTION

In general terms, drop ceilings are suspended below the actual ceiling to restrict the view of the ceiling and create a more appealing view from the floor. Suspended drop ceilings are usually hung at a distance below the structural members to hide mechanical and electrical equipment, along with electrical conduit, HVAC ducts, water pipes, sewage lines, lighting fixtures, and similar structures. In order to construct a suspended drop ceiling, a metal grid is suspended from the actual drop ceiling, usually by wires, and acoustical or similar tiles, are inserted and supported by the grid.

In order to minimize excessive and/or unwanted sound generated because of the exposed ceiling, one solution is to hang product from the ceiling at certain intervals to allow for the exposed ceiling to be viewed, but to reduce the acoustic profile. As an example of a structure intended to reduce unwanted noise is the Supported Architectural Structure disclosed and claimed in U.S. Pat. No. 8,782,987, to Kabatsi et al., which discloses a plurality of primary supports configured to couple with one or more architectural structures, and a plurality of flexible fins is incorporated into the structure using primary supports, secondary supports and attachment points.

Another example of a drop ceiling structure is U.S. patent application Ser. No. 10/774,233, to Stackenwalt et al, which discloses a decorative structure, which may be curved, suspended within a space and which includes a panel fastened to a support structure by a clip, a portion of which extends along a face of the panel.

These examples utilize additional supports, attachment hardware and clips to assist in suspending the flexible fins or decorative panels to the drop ceiling or to drop ceiling structure. In doing so, each of these examples necessitate tools to assemble the structure and to suspend the structure to the drop ceiling or drop ceiling support structure.

As such there is a need for a dynamic acoustic fluctuating ceiling system that includes multiple shaped ceiling product that can be quickly and easily installed onto existing construction drop ceiling hangers or similar support structures without the need for tools, separate attachment devices, clips or the like. There is also a need for a dynamic acoustic fluctuating ceiling system that is an aesthetically pleasing image, such as a fluctuating image, along with the function of reducing unwanted noise.

The foregoing is intended only to illustrate the present technical field and background art and should not be taken as a limitation or disavowal of claim scope.

BRIEF SUMMARY

The present disclosure is an improved acoustic ceiling product or tile, and an improved dynamic acoustic ceiling system, along with improved methods for installing the ceiling tile and creating the dynamic acoustic ceiling system. Although the disclosure herein pertains to any shaped ceiling tile or a flat ceiling tile, the preferred embodiment comprises fluctuating design that includes four differently shaped ceiling tiles, that when combined create a fluctuating ceiling design.

It should be understood that the ceiling system can include a single ceiling tile design, or any multiple of ceiling tile designs, and that the ceiling tile design may also be a flat tile. All of the ceiling tile designs comprise the attached or embedded magnetic assemblies that can be removed and reattached as necessary to create an optimal attachment and/or to allow for a modified ceiling tile to be likewise attached to the ceiling system. Additionally, throughout the present disclosure, for ease of reference and explanation, the ceiling system and tiles are referred to as fluctuating ceiling product, fluctuating ceiling tiles and fluctuating ceiling system. These references are not meant to limit the scope of the present disclosure in which the system and tiles may be flat or another shape altogether.

The improvement comprises fluctuating ceiling tile that is configured with attached or embedded magnetic assemblies in such a configuration that the tile can be quickly and easily installed onto or into drop ceiling hangers, drop ceiling structures or any other ceiling structure, to provide an aesthetically pleasing image, such as a fluctuating or creased image, along with functioning to reduce unwanted noise or room acoustics.

The present disclosure comprises a fluctuating ceiling product that is manufactured from a recyclable and/or recycled material, such as recycled polyester felt or PET Felt, and in an embodiment, provides that each fluctuating ceiling tile is configured from a piece of the PET Felt for strength, and has a fluctuating or undulating shape across the area of the tile. In this embodiment, the fluctuating ceiling tile is generally a square or rectangular shape with each side comprising one or more magnetic assemblies attached to the ceiling tile as described herein. The fluctuating ceiling tile and magnet assembly configuration allows for the fluctuating ceiling tile to be attached or installed into the drop ceiling hanger (or ceiling structure) without the need for tools, clips or any additional attachment devices. Multiple fluctuating ceiling tiles, comprising either the same design or a different design, can be installed or attached to the ceiling structure to create the fluctuating ceiling system comprising multiple fluctuating ceiling tiles. Additionally, each ceiling tile can be attached to the ceiling structure over the existing standard ceiling tile, which is normally installed in a cantilever process that shows the hanger structure. This allows for easy installation over existing standard ceiling tiles without taking time to remove the existing tiles.

The present disclosure comprises embedded or attached magnetic assemblies that can be removed and installed at a different location on each tile to create an optimal attachment to the ceiling structure, or when necessary, to be relocated if a particular ceiling tile is cut down or modified from its original size, to avoid an obstruction or structure in the ceiling, for example, such as a sprinkler system, ductwork, or other structure. In that instance, the magnet assembly can be removed from the ceiling tile, the ceiling tile can then be cut or reconfigured to avoid the obstruction, and the magnetic assembly can be re-attached on the redesigned or reworked ceiling tile. The reworked or modified ceiling tile can then be attached to the ceiling structure using the relocated magnetic assembly.

The present disclosure further relates to an improved dynamic acoustic fluctuating ceiling system comprising a number of differently shaped fluctuating ceiling tiles that can be installed into a ceiling structure such that the system, as a whole, provides an aesthetically pleasing image, such as a creased or fluctuating image, based on the placement of the differently shaped fluctuating ceiling tile. As a non-limiting example, four fluctuating ceiling tile designs can make up a larger tile that can be replicated at different locations in a room ceiling. By strategically placing the tiles (each made up of fluctuating designs) in multiple different locations, the ceiling design can be modified. Further, depending on the fluctuating ceiling design for a particular tile, there may only be two designs necessary, as reversing the ceiling tiles may provide the desired effect, to create a crease or fluctuating image.

The present disclosure also relates to an improved method of installing the ceiling product or tiles and creating the dynamic acoustic fluctuating ceiling system, in which the acoustic fluctuating ceiling tiles are installed into the ceiling structure by snapping the magnetic assemblies attached or embedded in the fluctuating ceiling tile over the existing ceiling hanger, without the need for additional tools, clips or additional attachment devices, to provide an aesthetically pleasing image, and to function to reduce unwanted noise or room acoustics.

It is thus an objective of the present disclosure to provide an improved acoustic fluctuating ceiling product or tile, comprising attached or embedded magnetic assemblies, which allow for the fluctuating ceiling tiles to be installed into an existing drop ceiling hanger or ceiling structure without the need for tools, clips or additional attachment devices.

It is another object of the present disclosure to provide an improved dynamic acoustic fluctuating ceiling system in which the improved fluctuating ceiling tiles comprise one or more magnetic assemblies that can be attached, removed, and reattached to each ceiling tile to create an optimal attachment to the ceiling structure, and to allow for the modification or alteration of a ceiling tile, as needed, and reattachment of the magnetic assemblies on the altered ceiling tile.

It is yet another object of the present disclosure to provide an improved dynamic acoustic fluctuating ceiling system in which the improved fluctuating ceiling tiles are installed in a manner and pattern that creates an aesthetically pleasing image and functions to reduce unwanted noise or room acoustics.

It is yet another objective of the present disclosure to provide an improved method for installing the improved fluctuating ceiling product and thereby creating the dynamic acoustic fluctuating ceiling system with an aesthetically pleasing image and which functions to reduce unwanted noise or room acoustics.

Additional objectives and advantages of the present disclosure will become apparent to one having ordinary skill in the art after reading the specification in light of the drawing figures, however, the spirit and scope of the present invention should not be limited to the description of the embodiments contained herein.

BRIEF DESCRIPTION OF THE DRAWINGS

FIG. 21 is a chart of acoustic testing in accordance with ASTM C423 of the ceiling baffles in accordance with the present disclosure.

DETAILED DESCRIPTION

As stated herein, the objective of the present disclosure is to provide an improved dynamic acoustic ceiling product or tile, and an improved dynamic acoustic ceiling system, along with improved methods for installing the ceiling tile and creating the dynamic acoustic ceiling system.

Figure 1:
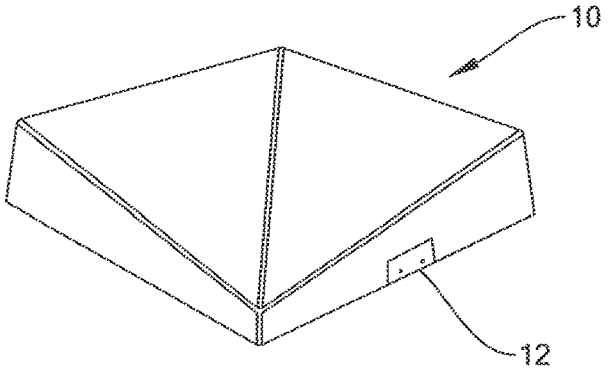
FIG. 1 is an exemplary perspective view of an acoustic fluctuating ceiling product in accordance with the present disclosure.

Referring to the drawings, wherein like reference numerals refer to the same or similar features in the various views, FIGS. 1 through 20 show different views of the improved product or tile section 10 (along with the installation items), which in the preferred embodiment shown in FIG. 1 is a made up of polyester felt or PET Felt. Each tile section 10 in the preferred embodiment replaces about 24 inches by 24 inches of ceiling space, and each fluctuating ceiling product 10 is about 24 inches long by 24 inches wide, with varying heights, up to 8 inches or higher, throughout the product to provide a fluctuating image when desired. The ceiling product 10 is made from 5 mm thick PET Felt, and in the preferred embodiment is made with recycled polyester plastic, up to 99% of which comes from recycled water bottles. The ceiling tiles comprise one or more magnetic assemblies 12 on each side in a first location for installation purposes.

Figure 2:
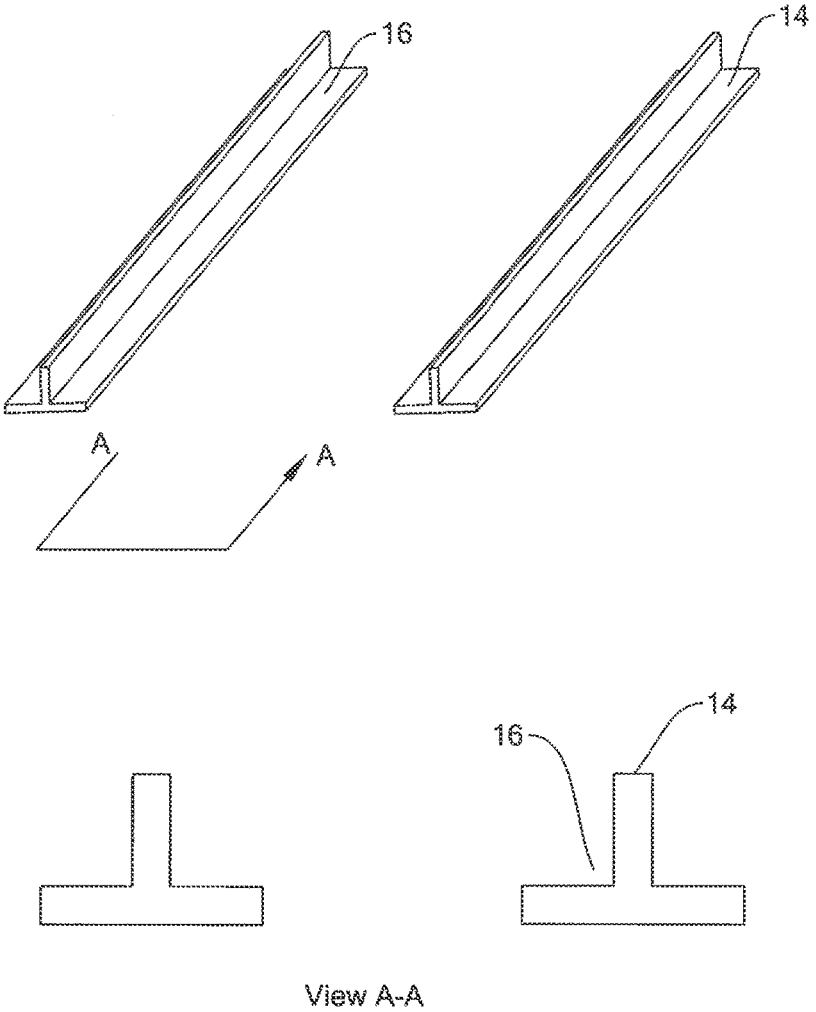
FIG. 2 is a perspective view and the associated cut away view of a prior art standard drop ceiling hanger in accordance with the present disclosure.

As described herein, multiple magnetic assemblies 12 are used on one or more sides of each ceiling tile 10 (or in other optimal locations on the ceiling tile), to allow the ceiling tile 10 to be attached to the ceiling structure 14 (shown in FIG. 2). Each magnetic assembly 12 is configured to be attached and removed from the ceiling tile 10, as necessary, and relocated onto another location on the ceiling tile 10 for optimal attachment performance, or if the ceiling tile 10 needs to be modified or reconfigured to avoid a ceiling obstacle, such as sprinkler heads, HVAC vents, smoke detectors, among other obstacles.

As such, the magnetic assemblies 12 can be removed from the first location and reattached at a second location on the same side or edge of the ceiling tile, on a different side or edge of the ceiling tile, or not reattached at all, if desired.

FIG. 2 and view A-A show a perspective and side view (see also FIG. 3D) of an exemplary ceiling structure, in this example, a standard drop ceiling hanger 14. The standard drop ceiling hanger 14 is normally configured and sized to hold a standard acoustic tile (not shown), approximately two feet by two feet, although different size tiles are available, by laying the standard ceiling tile onto the edges of the hanger 16 in a cantilever arrangement. In doing so, the installed standard ceiling tile blocks the view of the actual ceiling (not shown), but does not block the view from below of the underside of the edge 16 of the hanger 14. In some cases, sprinkler systems and vents have to be extended to be accessible to the area below the standard ceiling tile, and in some cases, the standard ceiling tile has to be cut or modified to allow access to a sprinkler head, vent, etc.

Figure 3A:
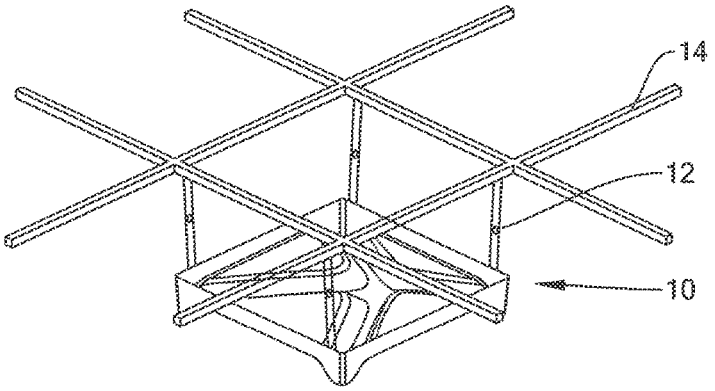
FIGS. 3A and 3B are perspective views of a prior art standard drop ceiling hanger system with installations of a tile in accordance with the present disclosure.
Figure 3B:
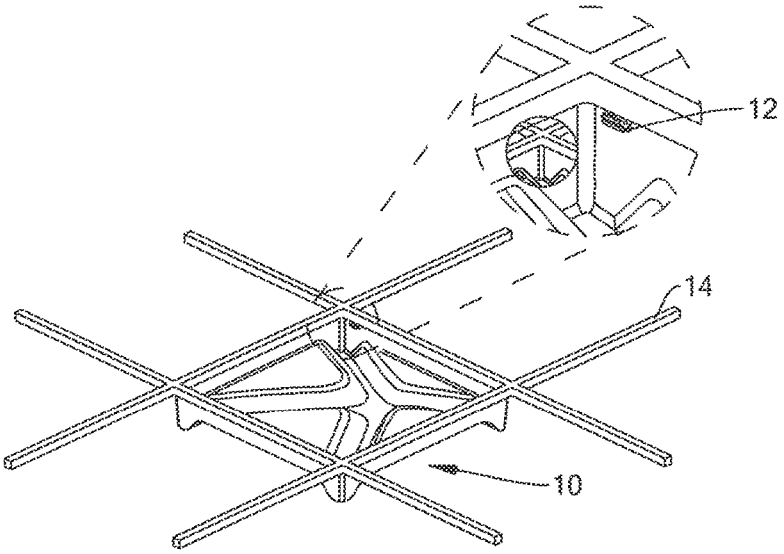

FIG. 3A shows a perspective views of a fluctuating ceiling product or tile 10 being installed into a prior art standard drop ceiling hanger 14 system, and after installation onto that hanger 14 (shown in FIG. 3B). Again, the scope of the present disclosure is not limited to a fluctuating ceiling tile or a drop ceiling hanger, and may apply to other ceiling tile designs (including flat tiles) and other ceiling systems.

In the preferred embodiment, one or more magnetic assemblies 12 are attached to or embedded into each fluctuating ceiling product 10 on each edge, thereby allowing for the fluctuating ceiling product 10 to be attached or snapped into place against the ceiling hanger 14 from below, as described herein, and completely or mostly block the view of the ceiling hanger 14 from below. Each fluctuating ceiling tile 10 may be a different size and shape, or some or all of the products may be the same size and shape, thereby creating different fluctuating, crease or other designs. By combining the different fluctuating ceiling product 10, which are made up of the different designs and shapes, a fluctuating design can be created.

Figure 3C:
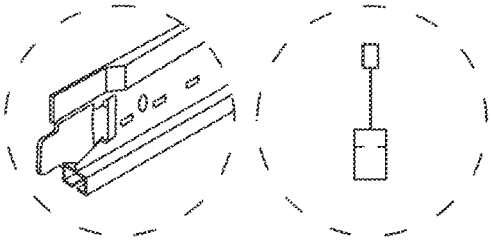
FIGS. 3C and 3D are perspective views of various prior art standard drop ceiling hanger systems in accordance with the present disclosure.
Figure 3D:
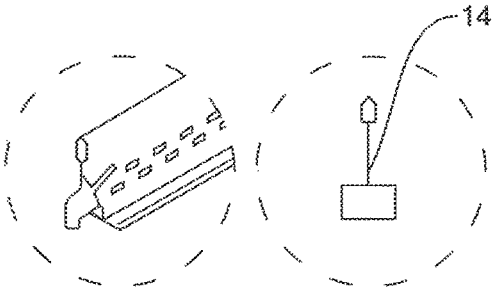

FIGS. 3C and 3D show different standard Tee Grip options for drop ceiling structures including 9/16 inch and 15/16 inch, with the latter option being shown in FIG. 2. The present fluctuating ceiling tile 10 will snap or connect to either option (and others) using the embedded magnetic assemblies 12 in the edges of the fluctuating ceiling product 10. As such, each ceiling tile can be magnetically attached to the existing ceiling structure, and even attached over the existing standard ceiling tile, which is normally installed in a cantilever process that shows the hanger structure. This allows for easy installation over existing standard ceiling tiles without taking time to remove the existing tiles and at the same time hides the ceiling structure from view from below.

FIGS. 4 through 7 show and example of the various fluctuating ceiling product 10 and details for those product 10. These are merely examples of the different fluctuating ceiling products 10 that can be used to create the overall fluctuating ceiling design and fully or mostly obscure the view of the hanger 14 or TEE Grid from below. For example, FIGS. 4A through 4D, referred to herein as Tile A, include a perspective view (FIG. 4A), plan view (FIG. 4B), side elevation view (FIG. 4C), and front elevation view (FIG. 4D). Tile A 10 is designed with a valley in one corner 20 that matches up with the other tiles 10 in the series, creating endless combinations and pattern variations.

Tile A, as previously shown in FIG. 1, makes up a portion of the dynamic acoustic fluctuating ceiling system. Tile A 10 is installed in a prior art standard drop ceiling hanger 14 by using the attached or embedded magnetic assemblies 12 (shown in the cutaway in FIG. 4A) in a first location 13, in accordance with the present disclosure. Tile A 10 is a 24 inch by 24 inch square with a 6 inch height from the highest point to the bottom. As seen from the perspective view (FIG. 4A) a diagonal runs through the ceiling tile 10 to the lowest point 20. Also shown on the ceiling tile 10 is a second location 18 in which a magnet assembly 12 can be reattached if the second location 18 is more optimal for securing the ceiling tile 10 to the ceiling structure. The magnetic assembly 12, as described herein, is capable of being removed from the first location 13 and reattached in a second location 18, whether on the same side of the ceiling tile 10 or a different side.

Figure 4A:
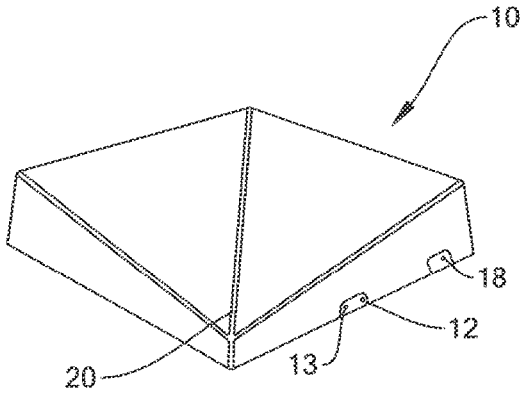
FIGS. 4A through 4D are perspective view (FIG. 4A), plan view (FIG. 4B), side elevation view (FIG. 4C), and front elevation view (FIG. 4D), of a fluctuating ceiling tile to be installed in a ceiling structure in accordance with the present disclosure.
Figure 4B:
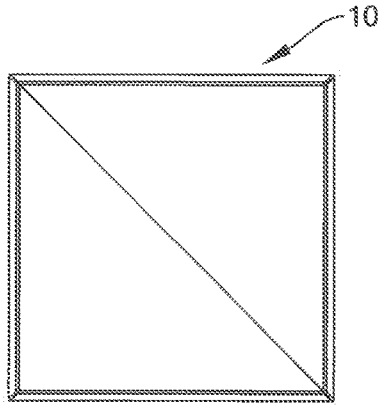
Figure 4C:
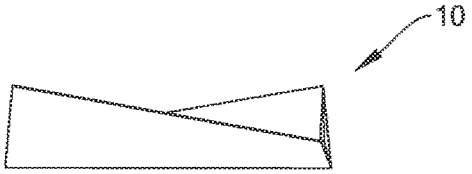
Figure 4D:
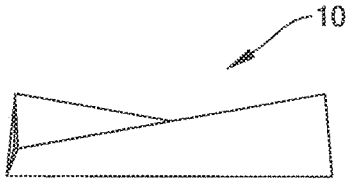

Although only shown on Tile A in FIG. 4A for the preferred embodiment, it should be understood that the magnet assembly 12 can be moved from the first location 13 to the same side of the ceiling tile 10, a different side of the ceiling tile 10, or removed altogether, if that particular magnet assembly 12 is no longer needed. Additionally, the functionality of the magnet assembly 12 as described herein, can be used on each of the ceiling tile 10 embodiments and alternative embodiments disclosed herein.

Figure 5A:
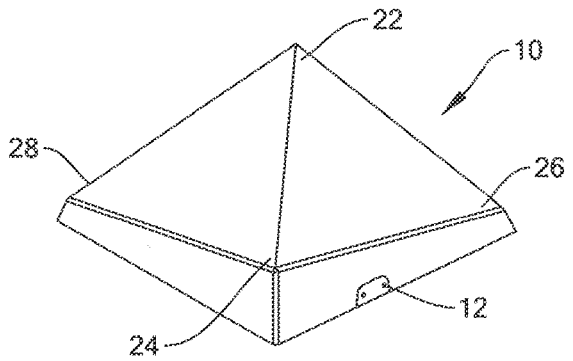
FIGS. 5A through 5D are perspective view (FIG. 5A), plan view (FIG. 5B), side elevation view (FIG. 5C), and front elevation view (FIG. 5D), of a fluctuating ceiling tile to be installed in a ceiling structure in accordance with the present disclosure.
Figure 5B:
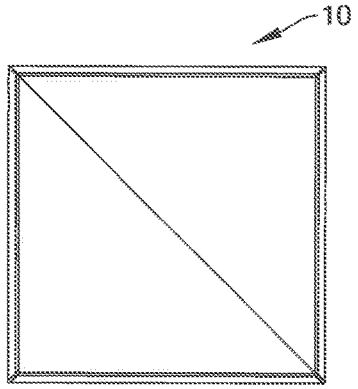
Figure 5C:
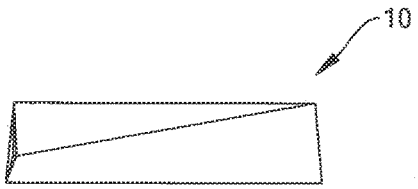
Figure 5D:
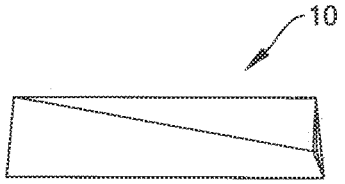

The ceiling tile 10 shown in FIGS. 5A through 5D, referred to herein as Tile B, and which include a perspective view (FIG. 5A), plan view (FIG. 5B), side elevation view (FIG. 5C), and front elevation view (FIG. 5D). Tile B 10 is designed with two peaks 22, 24 and two valleys 26, 28 that match up with the other tiles 10 in the series, creating endless combinations and pattern variations. Similarly, Tile B 10 is 24 inches by 24 inches, with the highest points being 6 inches from top to bottom (see FIG. 5C).

The Tile B dynamic acoustic fluctuating ceiling product 10 is installed in the prior art standard drop ceiling hanger 14 by using the attached or embedded magnetic assemblies 12 (shown in the cutaway in FIG. 5A), in accordance with the present disclosure.

Figure 6A:
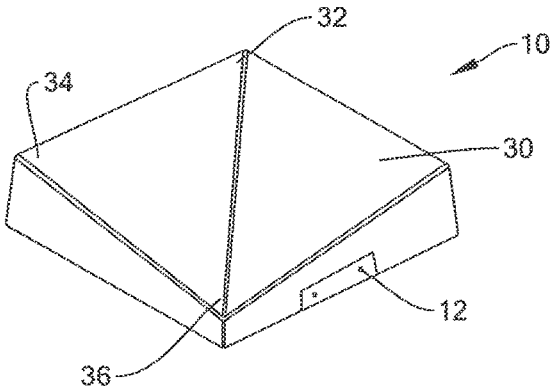
FIGS. 6A through 6D are perspective view (FIG. 6A), plan view (FIG. 6B), side elevation view (FIG. 6C), and front elevation view (FIG. 6D), of a fluctuating ceiling tile to be installed in a ceiling structure in accordance with the present disclosure.
Figure 6B:
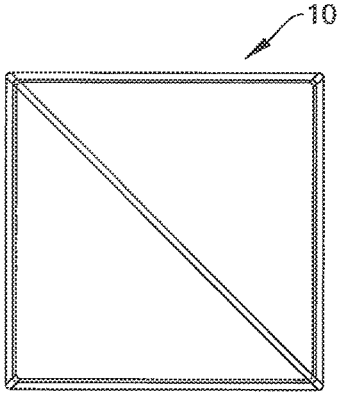
Figure 6C:
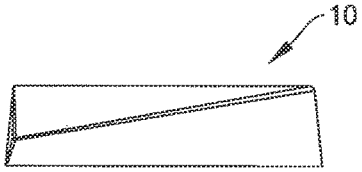
Figure 6D:
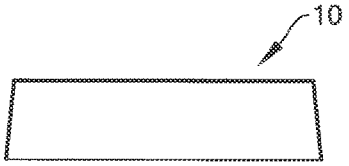

Likewise, ceiling tile 10 shown in FIGS. 6A through 6D, referred to herein as Tile C, and which include a perspective view (FIG. 6A), plan view (FIG. 6B), side elevation view (FIG. 6C), and front elevation view (FIG. 6D). Tile C 10 is designed with three peaks 30, 32, 34 and one valley 36 that match up with the other tiles 10 in the series, creating endless combinations and pattern variations. Tile C 10 is 24 inches by 24 inches, with the three highest points being 6 inches from top to bottom (see FIG. 6C).

The Tile C dynamic acoustic fluctuating ceiling product 10 is installed in the prior art standard drop ceiling hanger 14 by using the attached or embedded magnetic assemblies 12 (shown in the cutaway in FIG. 6A), in accordance with the present disclosure.

Figure 7A:
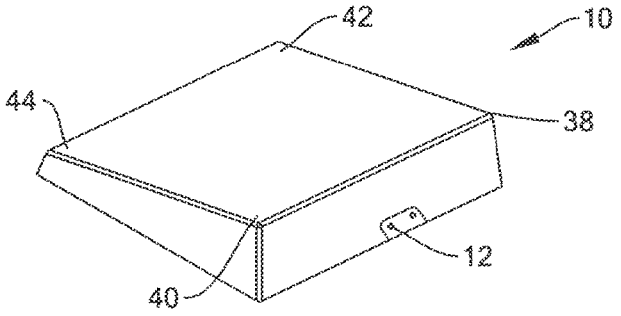
FIGS. 7A through 7D are perspective view (FIG. 7A), plan view (FIG. 7B), side elevation view (FIG. 7C), and front elevation view (FIG. 7D), of a fluctuating ceiling tile to be installed in a ceiling structure in accordance with the present disclosure.
Figure 7B:
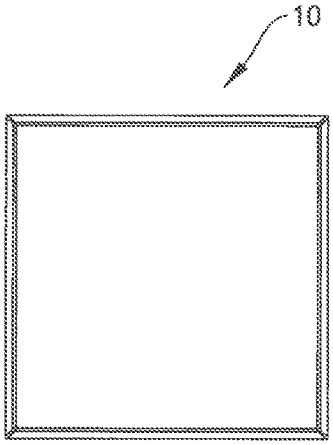
Figure 7C:
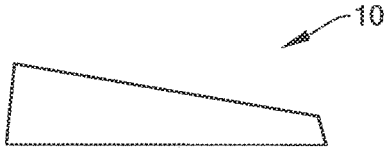
Figure 7D:
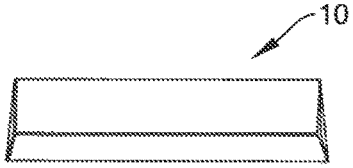

Finally, ceiling tile 10 is shown in FIGS. 7A through 7D, referred to herein as Tile D, and which include a perspective view (FIG. 7A), plan view (FIG. 7B), side elevation view (FIG. 7C), and front elevation view (FIG. 7D). Tile D 10 is designed with two peaks 38, 40 and two valleys 42, 44 that match up with the other tiles 10 in the series, creating endless combinations and pattern variations. Tile D 10 is also 24 inches by 24 inches, with the highest two points being 6 inches from top to bottom (see FIG. 7C).

The Tile D dynamic acoustic fluctuating ceiling product 10 is installed in the prior art standard drop ceiling hanger 14 by using the attached or embedded magnetic assemblies 12 (shown in the cutaway in FIG. 7A), in accordance with the present disclosure. Together, Tiles A, B, C and D 10 can be attached to any metallic ceiling system 14 using the attached magnetic assemblies 12 to create a fluctuating design as seen from the floor of the room and hiding the ceiling system. Additionally, to the extent the ceiling tiles 10 need to be modified, for example, to avoid obstacles in the ceiling (not shown), the attached magnetic assemblies 12, can be removed from the tile 10, and replaced in a more strategic location after the tile 10 has been modified to avoid the obstacle.

Figure 8A:
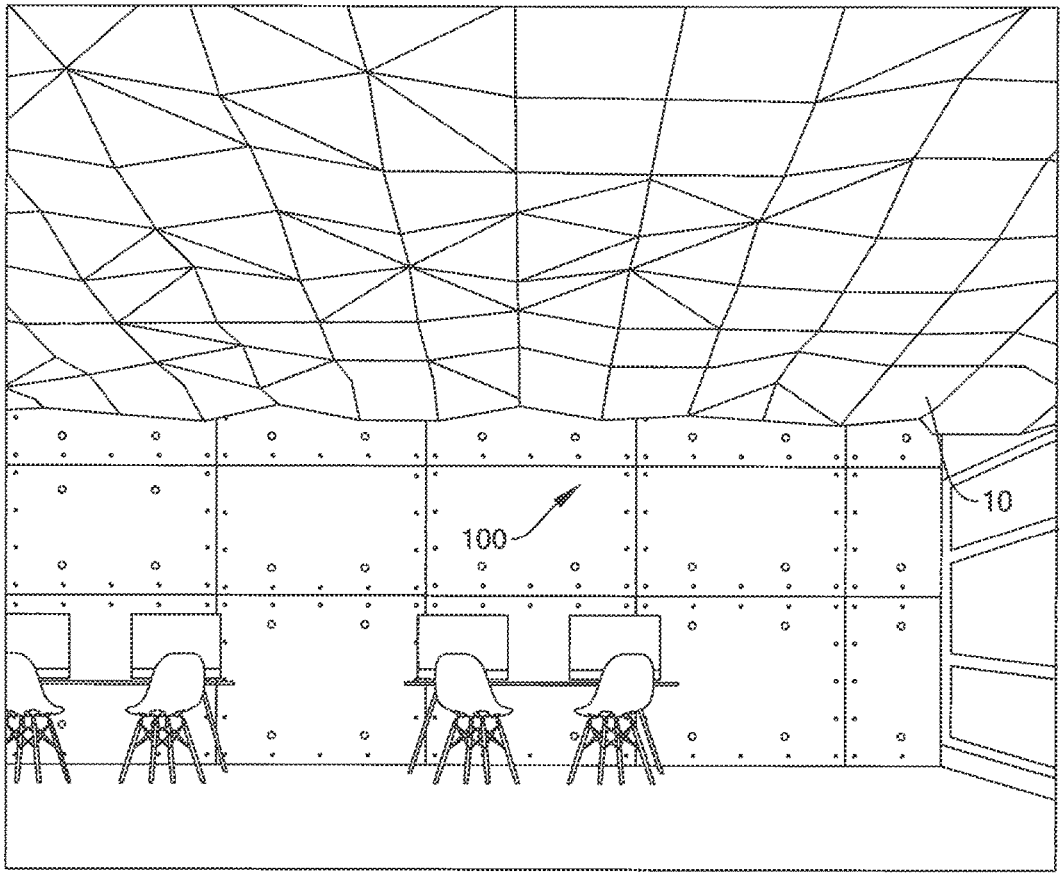
FIGS. 8A and 8B are perspective views of a fluctuating ceiling system installed in a prior art standard drop ceiling in accordance with the present disclosure.
Figure 8B:
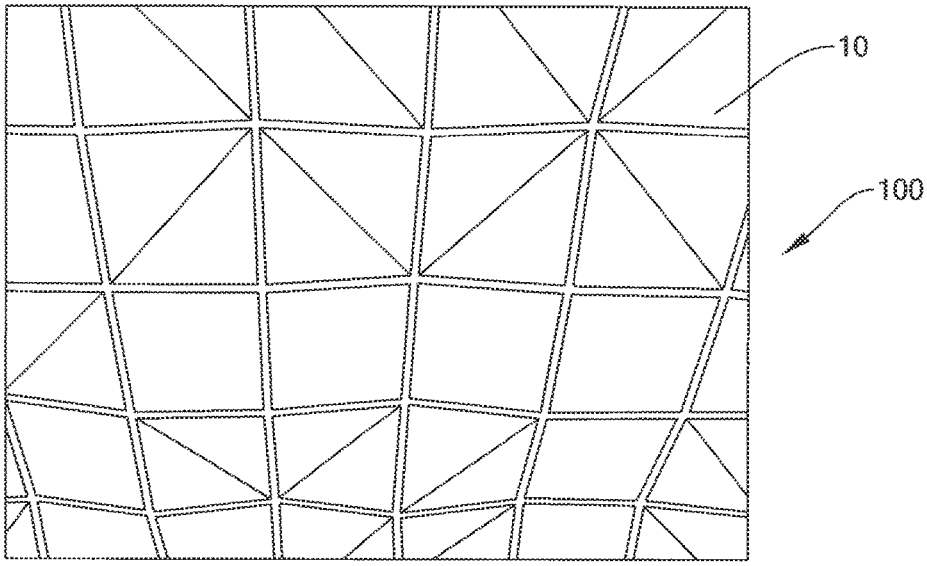

Tiles A, B C and D 10 can be repeated in different patterns throughout the ceiling to continue the fluctuating design effect. FIGS. 8A and 8B show ceiling system 100 utilizing multiple Tiles A, B, C and D 10 in combination as described herein. The TEE Grid or hanger 14 structure is not visible from below.

Figure 9A:
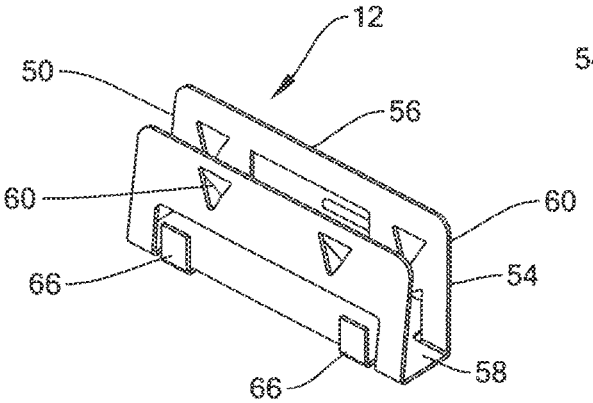
FIGS. 9A and 9B are perspective views of an exemplary magnet clip for attachment to the ceiling tile in accordance with the present disclosure.
Figure 9B:
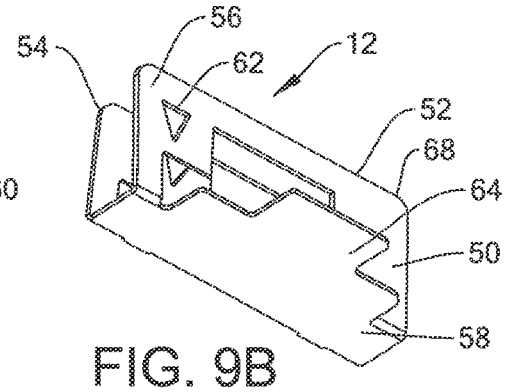

FIGS. 9A and 9B show an exemplary magnetic assembly 12 in accordance with the preferred embodiment, comprising a magnet retaining clip 50 that is used to hold or retain a magnet 52 (shown in FIG. 9B). As described herein, the magnet provides for the attachment of the ceiling tile to the ceiling system magnetically for ease of ceiling tile installation without the need for additional tools. The magnet has been removed in FIG. 9A to show the parts of the magnet retaining clip 50.

The magnet retaining clip 50 is made from steel, although other materials can be used. The steel also assists in keeping the magnet 52 in the proper location in the magnet retaining clip 50. Further, the steel material helps to keep the shape of the magnet retaining clip 50 and allows the magnet retaining clip 50 to be forced into an "open" position temporarily, and still retain its original shape once the force is removed. In the temporary open position, the magnet retaining clip 50 and thus the magnet 52 can be removed from the edge of the ceiling tile 10 and replaced at a different location on the same ceiling tile 10, as described herein.

FIG. 9A shows a front perspective view of the magnet retaining clip 50 after it has been bent into the clip shape. Generally, there is a front side 54 and a back side 56 and a bottom 58. In the preferred embodiment, the magnet retaining clip 50 is 0.3 mm thick, allowing for the magnet retaining clip 50 to be bent temporarily, as necessary, and the front side 54 is at an 80-degree slant from the bottom, while the back side 56 is perpendicular to the bottom. The bottom 58 is 32 mm long and 5.4 mm wide, while the front side 54 is 32 mm long and 11.5 mm high, and the back side 56 is 32 mm long and 13.2 mm high. Also in the preferred embodiment, two retaining borders 66 on the front side 54, help keep the edge of the ceiling tile 10, and thus the magnetic assembly 12, in the proper location.

When placed onto the edge of the ceiling tile 10, the front side 54 will slide over the bottom side of the tile 10, and the back side 56 will slide over the top side of the tile 10 until the ceiling tile edge makes contact with the bottom 58. In doing so, the magnet 52 will be exposed for attaching to the ceiling system.

Two front side retaining tabs 60 hold the magnet retaining clip 50 to the bottom of the ceiling tile 10. The back side 56 comprises two back side retaining tabs 62, which hold the magnet retaining clip 50 to the top of the ceiling tile 10 once the magnet retaining clip is slid into place. As described above, when the retaining clip 50 is forced into a temporary open position, for example by pulling the front side retaining tabs 60 away from the back side retaining tabs 62, the front side retaining tabs 60 will disengage from the bottom of the ceiling tile 10, and the back side retaining tabs will disengage from the top of the ceiling tile 10, thereby allowing the clip to be removed from the ceiling tile. The process can be repeated until the magnetic assembly 12 is located in the optimal position for attachment to the ceiling system.

FIG. 9B shows a back perspective view of the magnet retaining clip 50 after it has been bent into the clip shape. The magnet retaining tab 64 is located on the bottom 58 of the magnet retaining clip 50 near the back side 56. The magnet retaining tab 64 runs in the same direction as the bottom 58, but turns up at the end 68 to hold the magnet 52 in place. In the preferred embodiment, the magnet retaining tab is at a 70-degree angle. The magnet 52 is located on, and secured by, the magnet retaining tab 64.

Figure 10A:
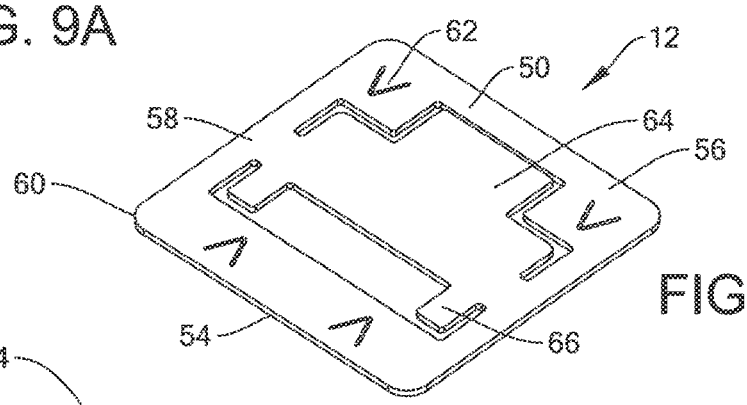
FIGS. 10A and 10B are plan and perspective views of an exemplary magnet clip design in accordance with the present disclosure.
Figure 10B:
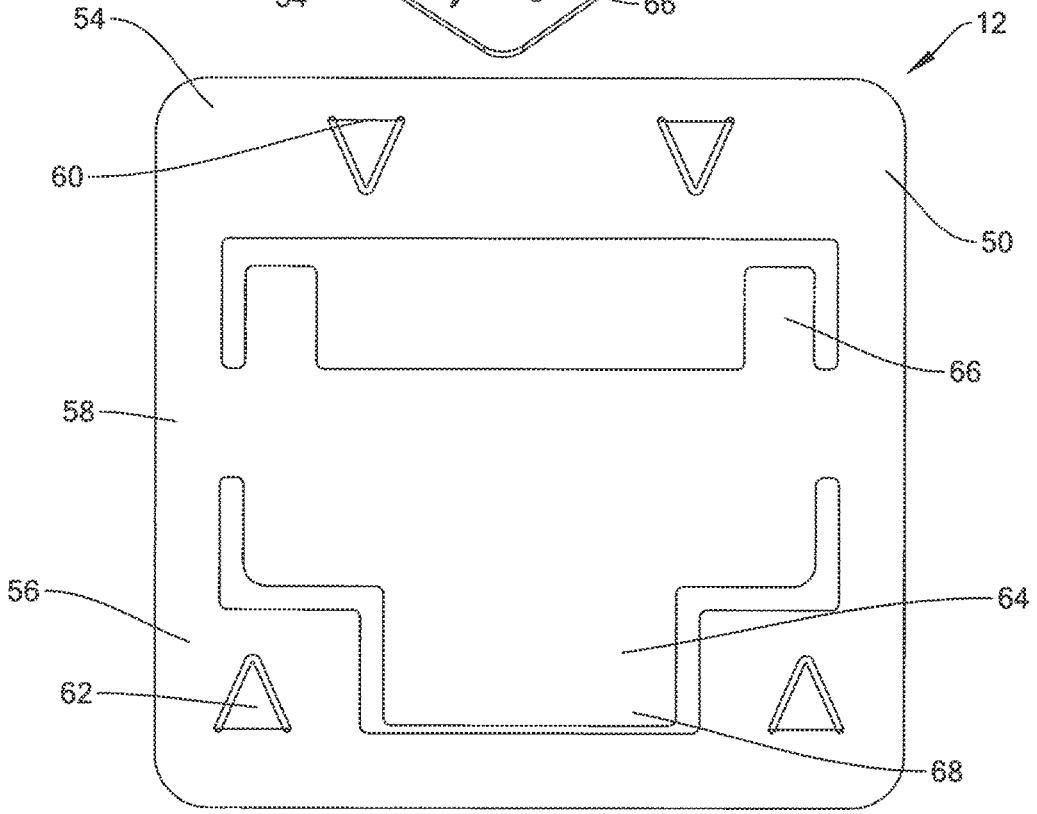

FIG. 10 A shows a perspective view and FIG. 10B show a plan view of the magnet retaining clip 50 prior to being bent into final clip shape. The magnetic retaining clip in the preferred embodiment is 32 mm by 30.4 mm and the front side 60 and back side 62 retaining tabs are 2.8 mm from top to bottom. The two retaining borders 66 are 3.6 mm high once bent and 3 mm wide. The magnet retaining tab 64 is approximately 7.8 mm wide after the edge of the magnet retaining tab 64 has been bent up to assist in securing the magnet 52. Of course, many other shapes and sizes can be utilized to obtain the same or similar functionality as the preferred embodiment of the magnet retaining clip, and those other shapes and sizes are covered by the scope of the present disclosure.

As stated throughout, the present disclosure is not limited in scope to the four preferred embodiment ceiling tiles 10 set forth in FIGS. 4 through 7 above, but instead pertain to a number of different ceiling tiles 10 and different configurations. Each of the ceiling tile 10 designs described and disclosed herein are exemplary ceiling tiles 10 and can be incorporated with the magnet assembly 12 including the magnet retaining clip 50 and magnet 52, among other embodiments.

Figure 11A:
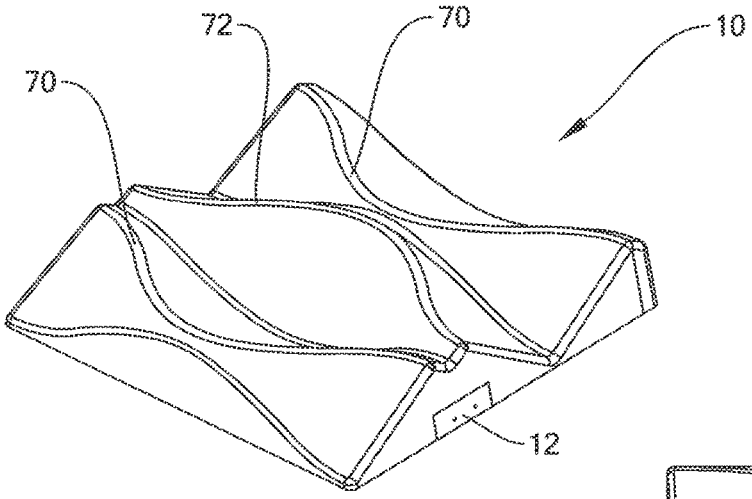
FIGS. 11A through 11D are illustrations of an alternative embodiment fluctuating ceiling tile to be installed in a ceiling structure in accordance with the present disclosure.
Figure 11B:
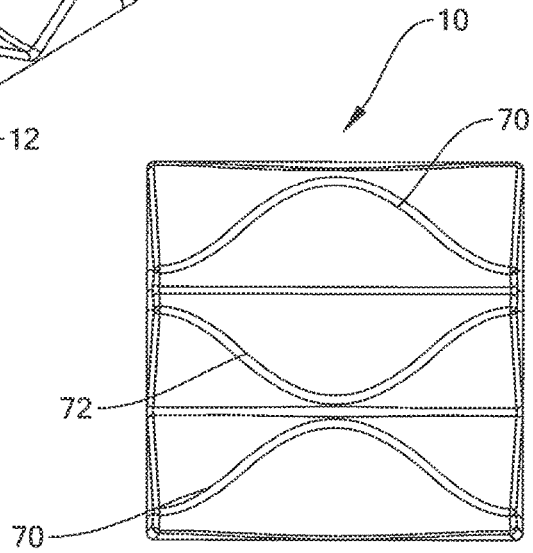
Figure 11C:
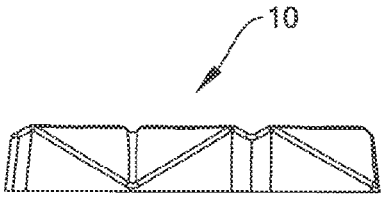
Figure 11D:
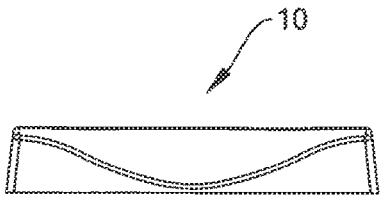

FIGS. 11A through 11D show a first alternative embodiment in which a ceiling tile 10, makes up a portion of the dynamic acoustic fluctuating ceiling system 100. In the first alternative embodiment, ceiling tile 10 is also installed in a prior art standard drop ceiling hanger 14 using the attached or embedded magnetic assemblies 12 (shown in the cutaway in FIG. 11A), in accordance with the present disclosure. As in the previous example, FIGS. 11A through 11D include a perspective view (FIG. 11A), plan view (FIG. 11B), side elevation view (FIG. 11C), and front elevation view (FIG. 11D).

Each ceiling tile 10 is a 24 inch by 24 inch square with a 4.5 inch height from the highest point to the bottom. As seen from the perspective and plan views (FIGS. 11A and 11B), three curved designs are used; two similar curves 70 running in the same direction, and one curve 72 running in the opposite direction. Each of these ceiling tiles 10 can be placed next to another ceiling tile 10 to continue the design throughout the ceiling system 100.

Figure 12A:
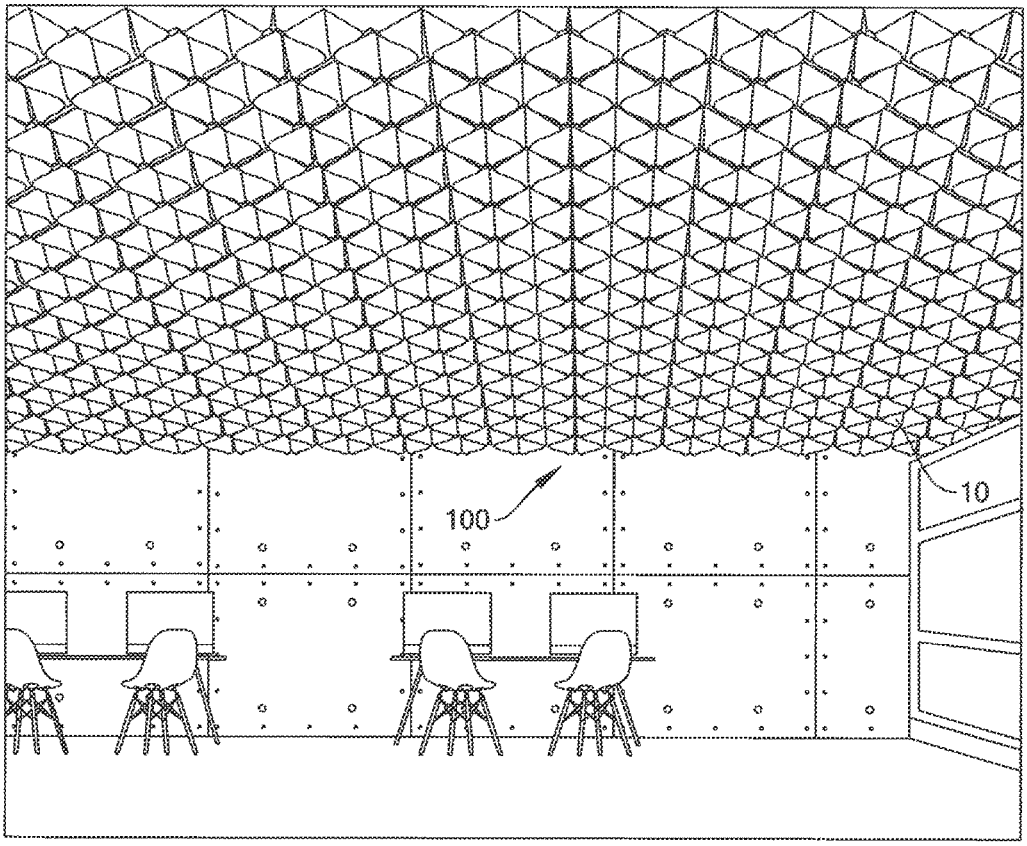
FIGS. 12A and 12B are perspective views of a fluctuating ceiling system installed in a prior art standard drop ceiling in accordance with the present disclosure.
Figure 12B:
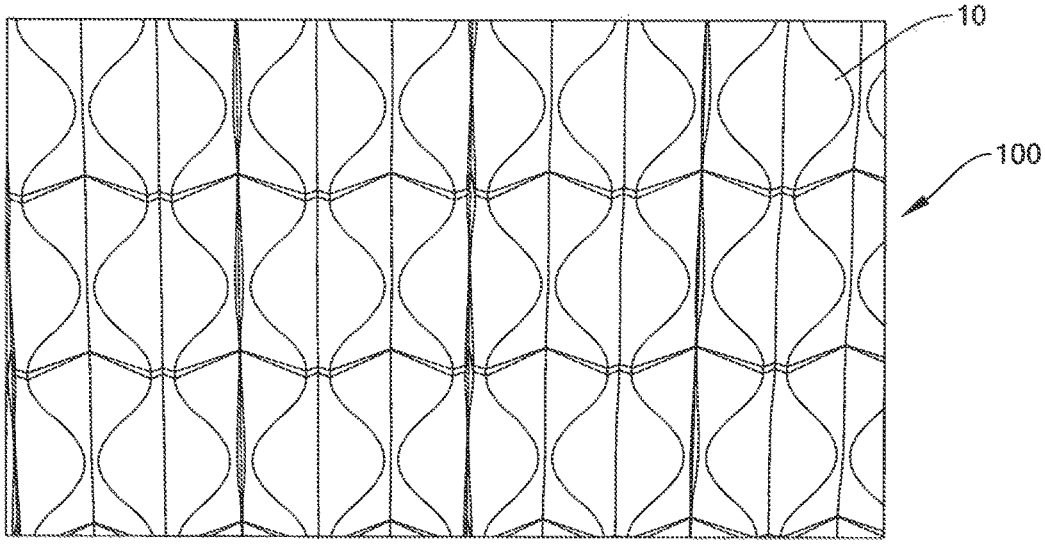

FIGS. 12A and 12B show an alternative embodiment for the ceiling system 100 using the ceiling tiles 10 from the first alternative embodiment with each ceiling tile 10 attached to the ceiling structure 14 using the magnetic assemblies 12. FIG. 12A shows the first alternative embodiment ceiling system 100 and FIG. 12B shows a close up of the ceiling system 100 for the first alternative embodiment.

Figure 13A:
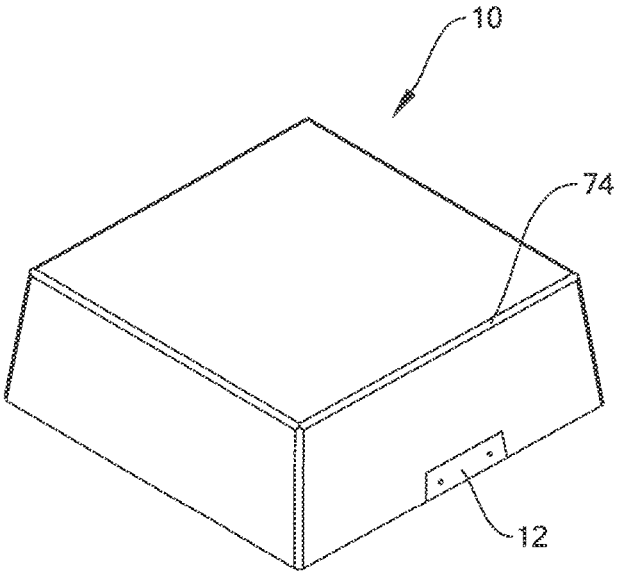
FIGS. 13A through 13D are illustrations of an alternative embodiment fluctuating ceiling tile to be installed in a ceiling structure in accordance with the present disclosure.
Figure 13B:
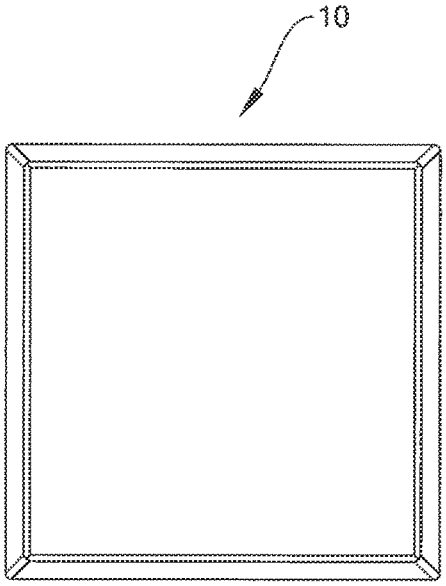
Figure 13C:
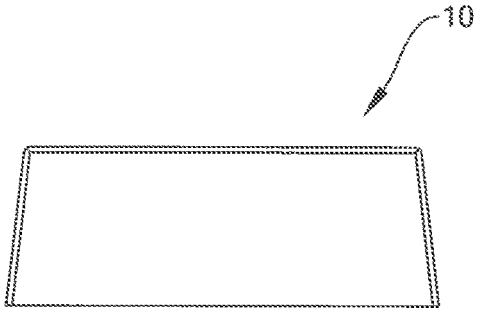
Figure 13D:
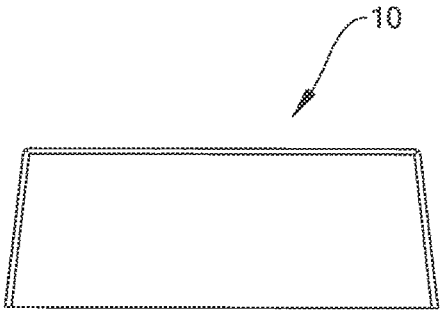

FIGS. 13A through 13D show a second alternative embodiment in which a ceiling tile 10, makes up a portion of the dynamic acoustic fluctuating ceiling system 100. In the second alternative embodiment, ceiling tile 10 is also installed in a prior art standard drop ceiling hanger 14 using the attached or embedded magnetic assemblies 12 (shown in the cutaway in FIG. 13A), in accordance with the present disclosure. As in the previous example, FIGS. 13A through 13D include a perspective view (FIG. 13A), plan view (FIG. 13B), side elevation view (FIG. 13C), and front elevation view (FIG. 13D).

Each ceiling the 10 is a 24 inch by 24 inch square with a height depending on the particular ceiling tile 10. In the second alternative embodiment, there are four different designs each having a different height. The second alternative ceiling tile 10 shown in FIG. 13C is an eight inch height from the highest point 74 to the bottom. The three other designs (not shown) include a six inch, four inch and two inch height from top 74 to bottom. Each of these four different ceiling tiles 10 can be placed next to another ceiling tile 10 to create a unique design throughout the ceiling system 100.

Figure 14A:
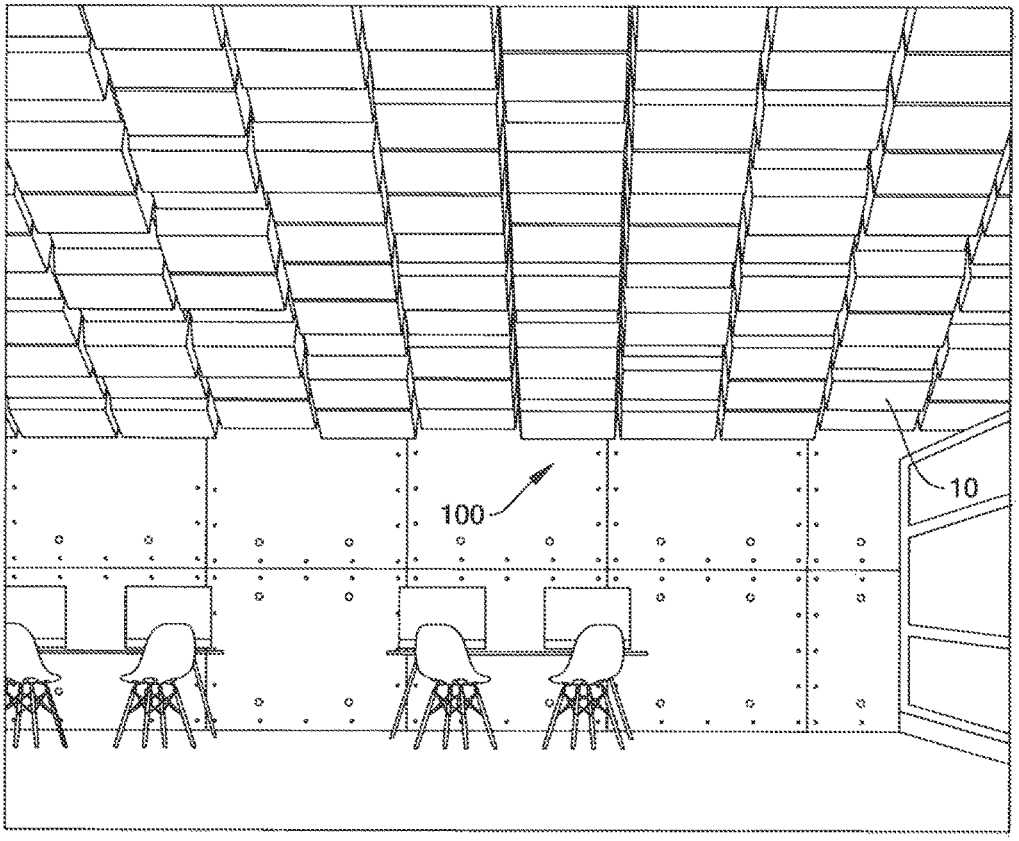
FIGS. 14A and 14B are perspective views of a fluctuating ceiling system installed in a prior art standard drop ceiling in accordance with the present disclosure.
Figure 14B:
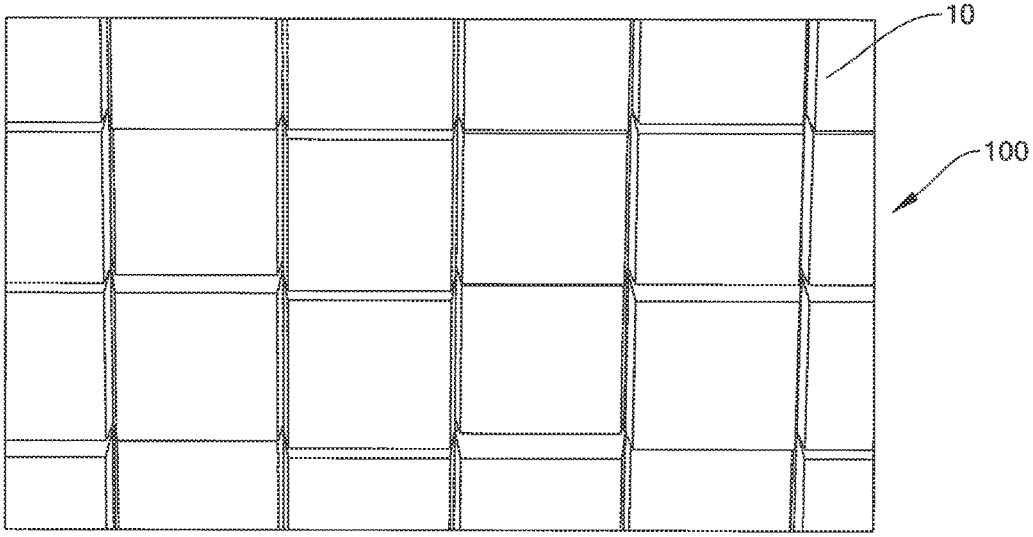

FIGS. 14A and 14B show an alternative embodiment for the ceiling system 100 using the ceiling tiles 10 from the second alternative embodiment with each ceiling tile 10 attached to the ceiling structure 14 using the magnetic assemblies 12. FIG. 14A shows the second alternative embodiment ceiling system 100 and FIG. 14B shows a close up of the ceiling system 100 for the second alternative embodiment.

Figure 15A:
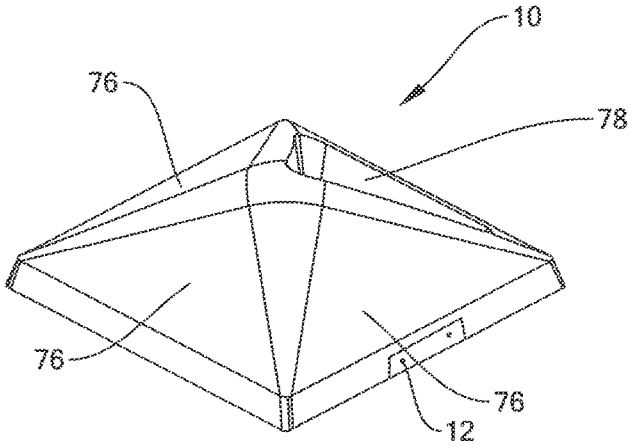
FIGS. 15A through 15D are illustrations of an alternative embodiment fluctuating ceiling tile to be installed in a ceiling structure in accordance with the present disclosure.
Figure 15B:
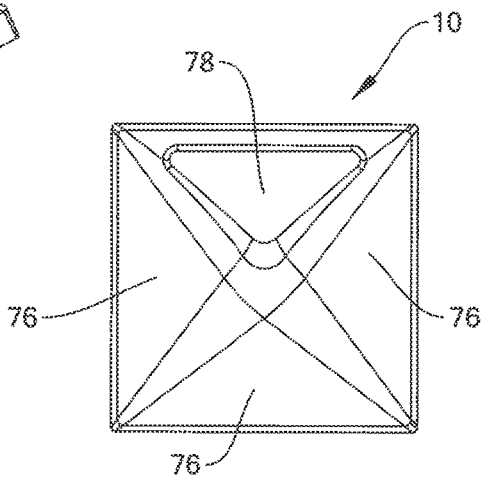
Figure 15C:
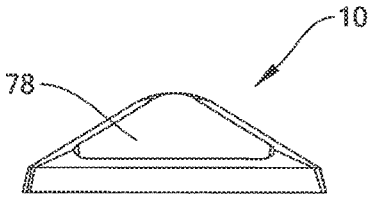
Figure 15D:
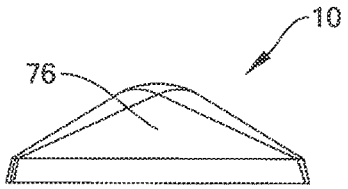

FIGS. 15A through 15D show a third alternative embodiment in which a ceiling tile 10, makes up a portion of the dynamic acoustic fluctuating ceiling system 100. In the third alternative embodiment, ceiling tile 10 is also installed in a prior art standard drop ceiling hanger 14 using the attached or embedded magnetic assemblies 12 (shown in the cutaway in FIG. 15A), in accordance with the present disclosure. As in the previous example, FIGS. 15A through 15D include a perspective view (FIG. 15A), plan view (FIG. 15B), side elevation view (FIG. 15C), and front elevation view (FIG. 15D).

Each ceiling tile 10 is a 24 inch by 24 inch square with a 4.5 inch height from the highest point to the bottom. As seen from the perspective and plan views (FIGS. 15A and 15B), a pyramid design is used; with three sides 76 comprising a solid side triangle shape and one side 78 comprising a triangle indent. Each of these ceiling tiles 10 can be placed next to another ceiling tile 10 to continue the design throughout the ceiling system 100.

Figure 16A:
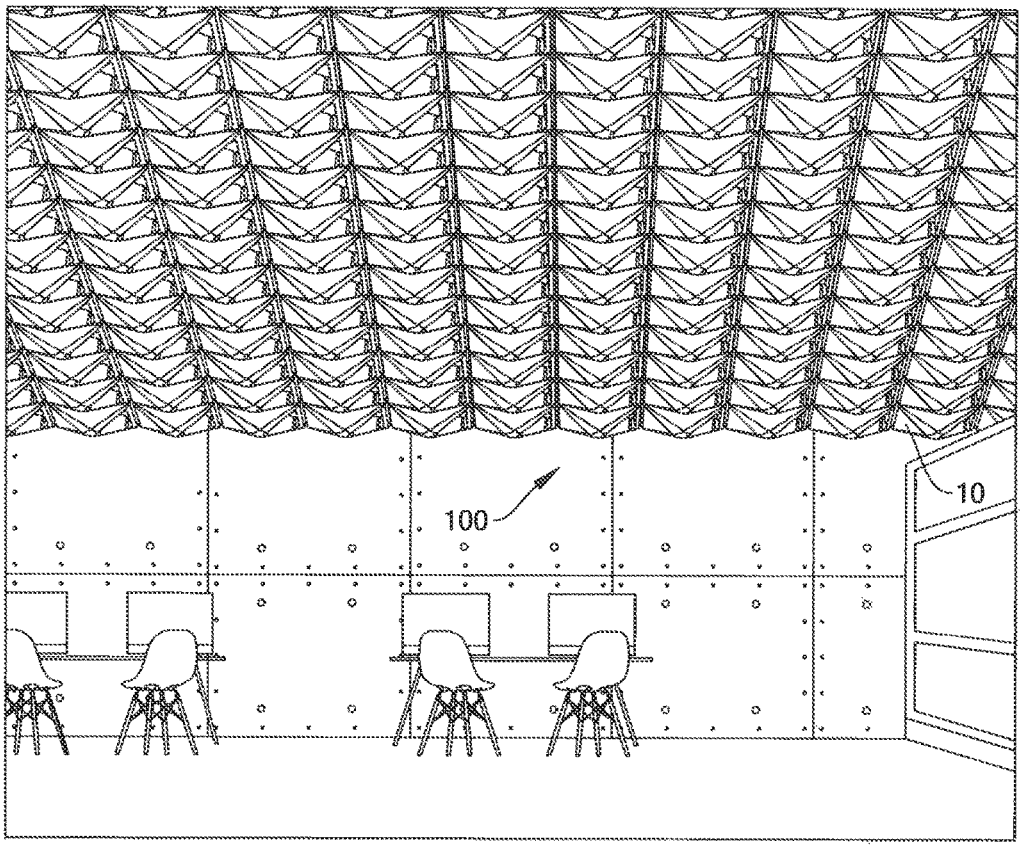
FIGS. 16A and 16B are perspective views of a fluctuating ceiling system installed in a prior art standard drop ceiling in accordance with the present disclosure.
Figure 16B:
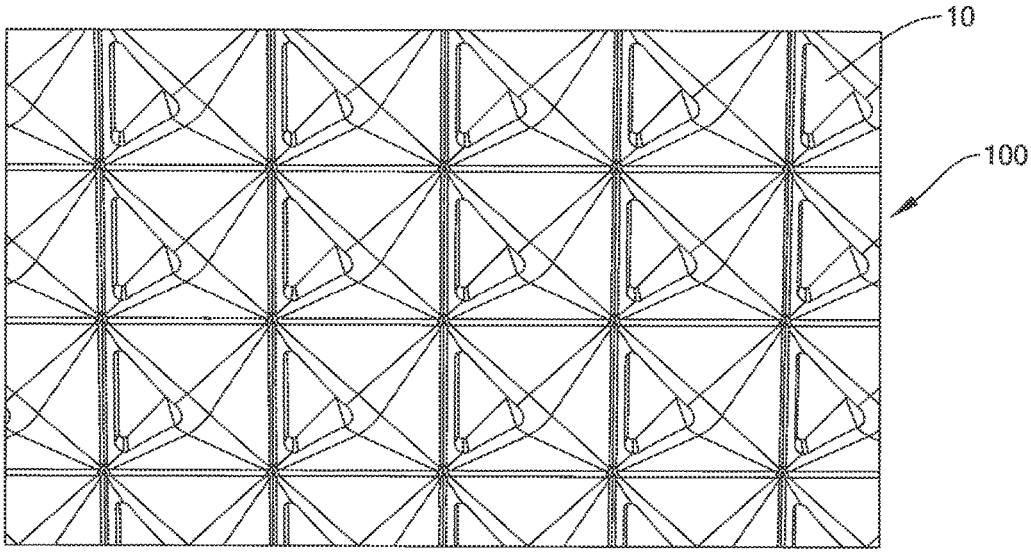
Figure 17A:
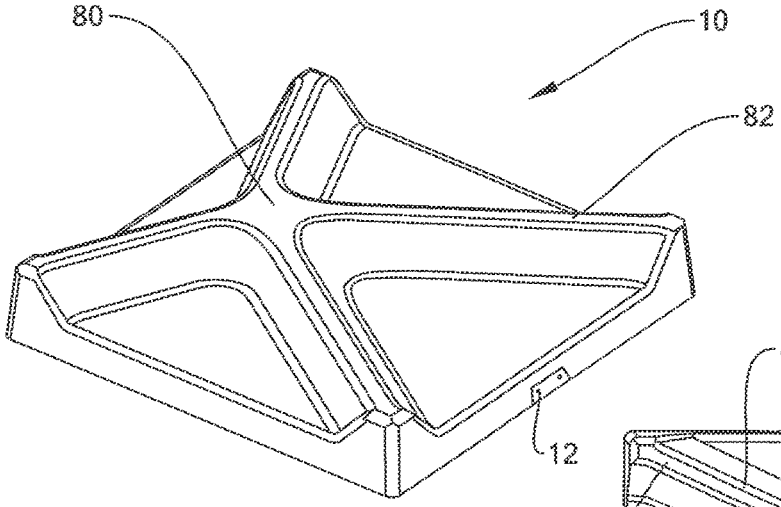
FIGS. 17A through 17D are illustrations of an alternative embodiment fluctuating ceiling tile to be installed in a ceiling structure in accordance with the present disclosure.
Figure 17B:
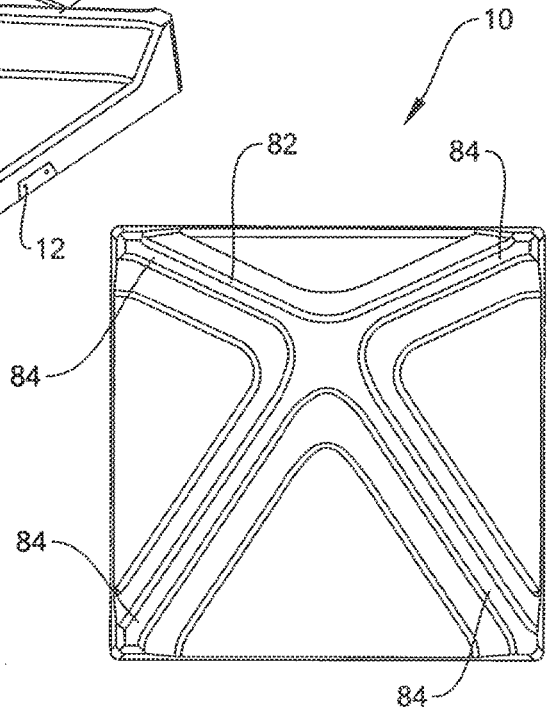
Figure 17C:
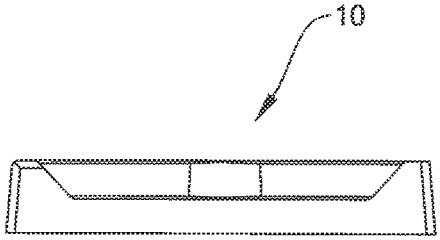
Figure 17D:
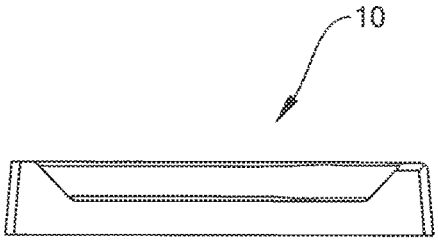

FIGS. 16A and 16B show an alternative embodiment for the ceiling system 100 using the ceiling tiles 10 from the third alternative embodiment with each ceiling tile 10 attached to the ceiling structure 14 using the magnetic assemblies 12. FIG. 16A shows the third alternative embodiment ceiling system 100 and FIG. 16B shows a close up of the ceiling system 100 for the third alternative embodiment.

FIGS. 17A through 17D show a fourth alternative embodiment in which a ceiling tile 10, makes up a portion of the dynamic acoustic fluctuating ceiling system 100. In the fourth alternative embodiment, ceiling tile 10 is also installed in a prior art standard drop ceiling hanger 14 using the attached or embedded magnetic assemblies 12 (shown in the cutaway in FIG. 17A), in accordance with the present disclosure. As in the previous example, FIGS. 17A through 17D include a perspective view (FIG. 17A), plan view (FIG. 1713), side elevation view (FIG. 17C), and front elevation view (FIG. 171)).

Each ceiling tile 10 is a 24 inch by 24 inch square with a 4.0 inch height from the highest point 80 to the bottom. As seen from the perspective and plan views (FIGS. 17A and 1713), an altered X design 82 is used; with the four ends 84 of the X design 82 contacting each corner of the ceiling tile 10. This design allows for the placement of each ceiling tile 10 adjacent to another ceiling tile 10 regardless of direction, creating the design throughout the ceiling system 100.

Figure 18A:
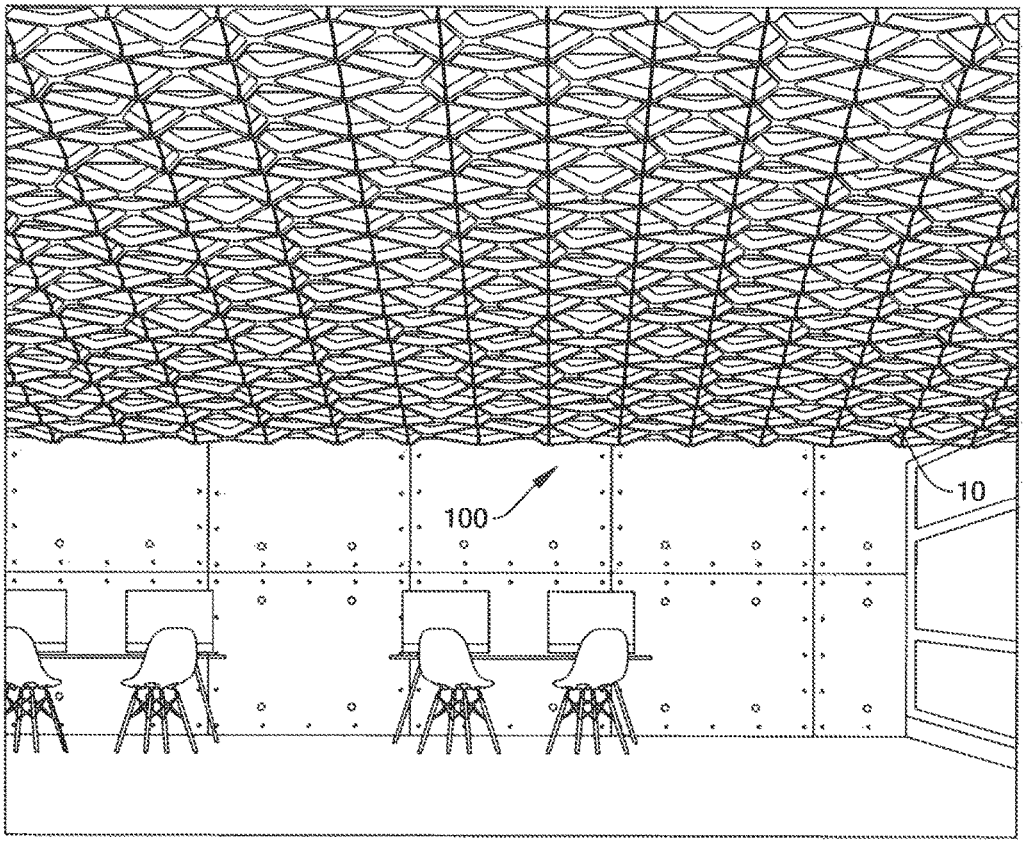
FIGS. 18A and 18B are perspective views of a fluctuating ceiling system installed in a prior art standard drop ceiling in accordance with the present disclosure.
Figure 18B:
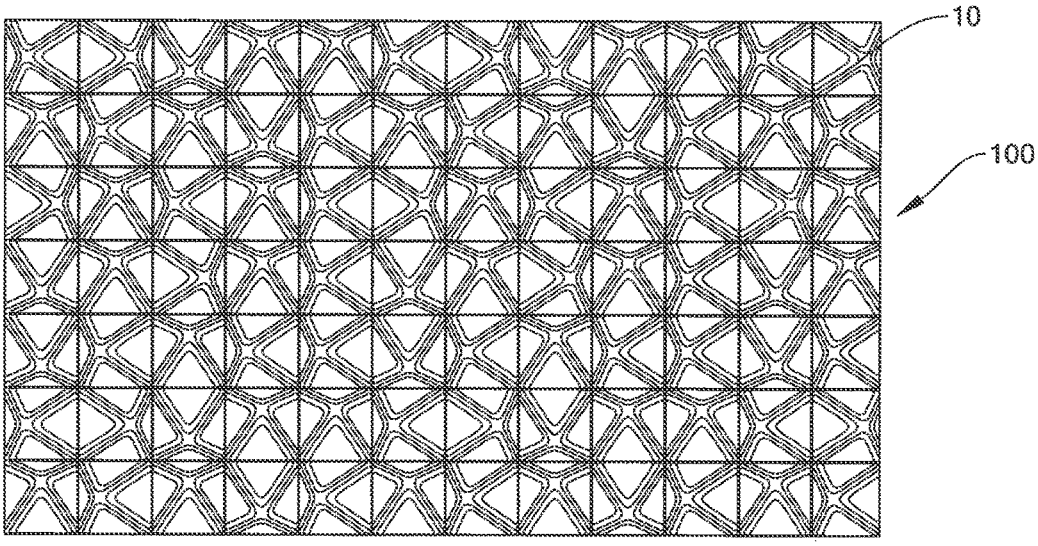

FIGS. 18A and 18B show an alternative embodiment for the ceiling system 100 using the ceiling tiles 10 from the fourth alternative embodiment with each ceiling tile 10 attached to the ceiling structure 14 using the magnetic assemblies 12. FIG. 18A shows the fourth alternative embodiment ceiling system 100 and FIG. 18B shows a close up of the ceiling system 100 for the fourth alternative embodiment.

Figure 19A:
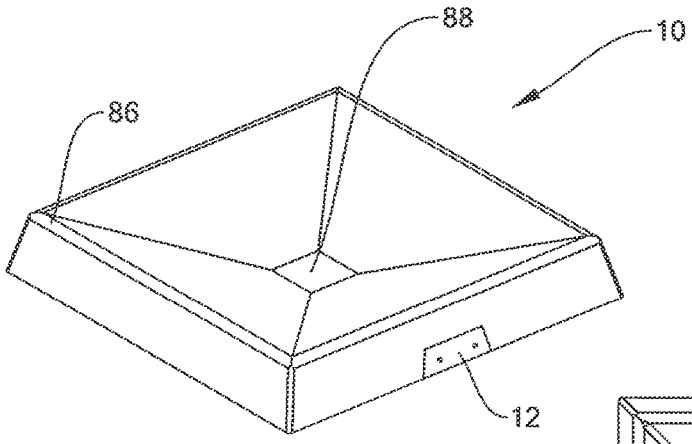
FIGS. 19A through 19G are illustrations of an alternative embodiment fluctuating ceiling tile to be installed in a ceiling structure in accordance with the present disclosure.
Figure 19B:
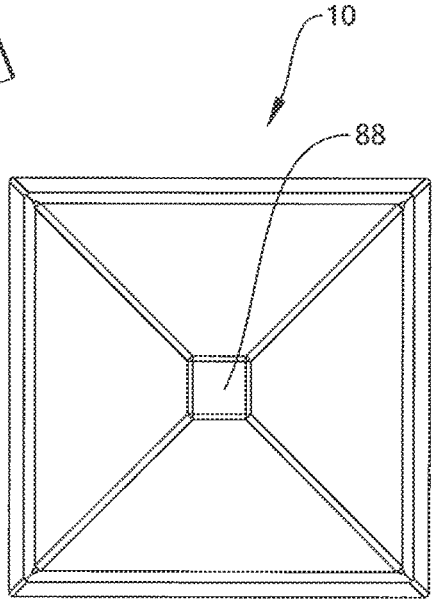
Figure 19C:
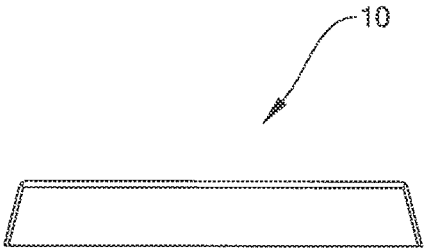
Figure 19D:
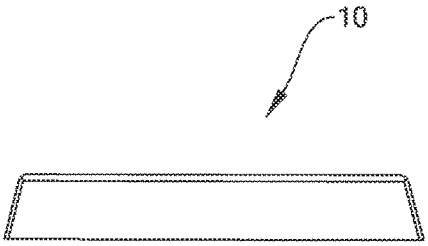
Figure 19E:
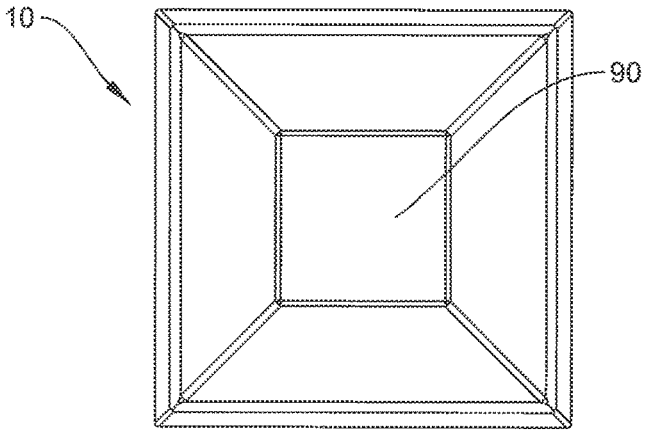
Figure 19F:
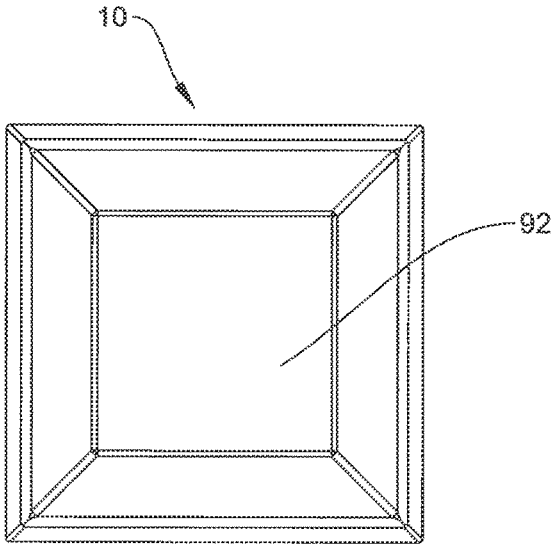
Figure 19G:
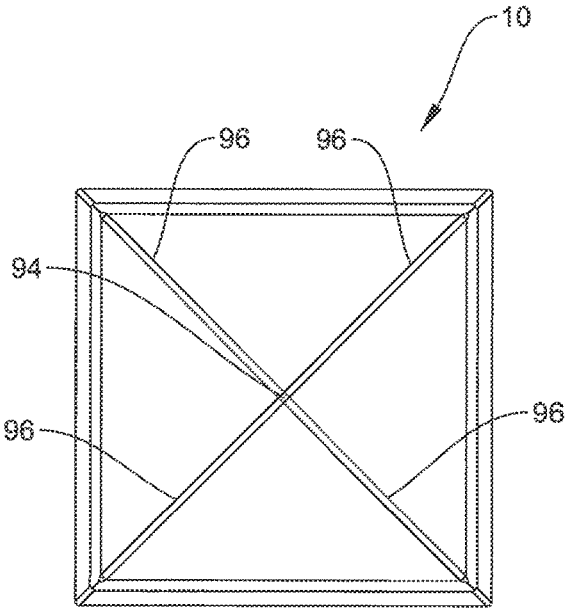

FIGS. 19A through 19G show a fifth alternative embodiment in which a ceiling tile 10, makes up a portion of the dynamic acoustic fluctuating ceiling system 100. In the fifth alternative embodiment, ceiling tile 10 is also installed in a prior art standard drop ceiling hanger 14 using the attached or embedded magnetic assemblies 12 (shown in the cutaway in FIG. 19A), in accordance with the present disclosure. As in the previous example, FIGS. 19A through 19D include a perspective view (FIG. 19A), plan view (FIG. 19B), side elevation view (FIG. 19C), and front elevation view (FIG. 190). FIGS. 19E through 19G show additional plan views for related ceiling tile designs.

Each ceiling tile 10 is a 24 inch by 24 inch square with a 4.0 inch height from the highest point 86 to the bottom. As seen from the perspective and plan views (FIGS. 19A, 19B, and 19E through 19G), a coffered ceiling tile 10 that uses different sized squares in the middle 88 of the ceiling tile 10 (or no square at all) is used. FIGS. 19B, 19E and 19F show a small 88, medium 90 and large 92 square in the center, respectively, while FIG. 19G shows no square in the center 94, only four diagonals 96 that run together in the center. These ceiling tile designs allow for placement of each ceiling tile 10 adjacent to another ceiling tile 10 (same or different) regardless of direction, creating the design throughout the ceiling system 100.

Figure 20A:
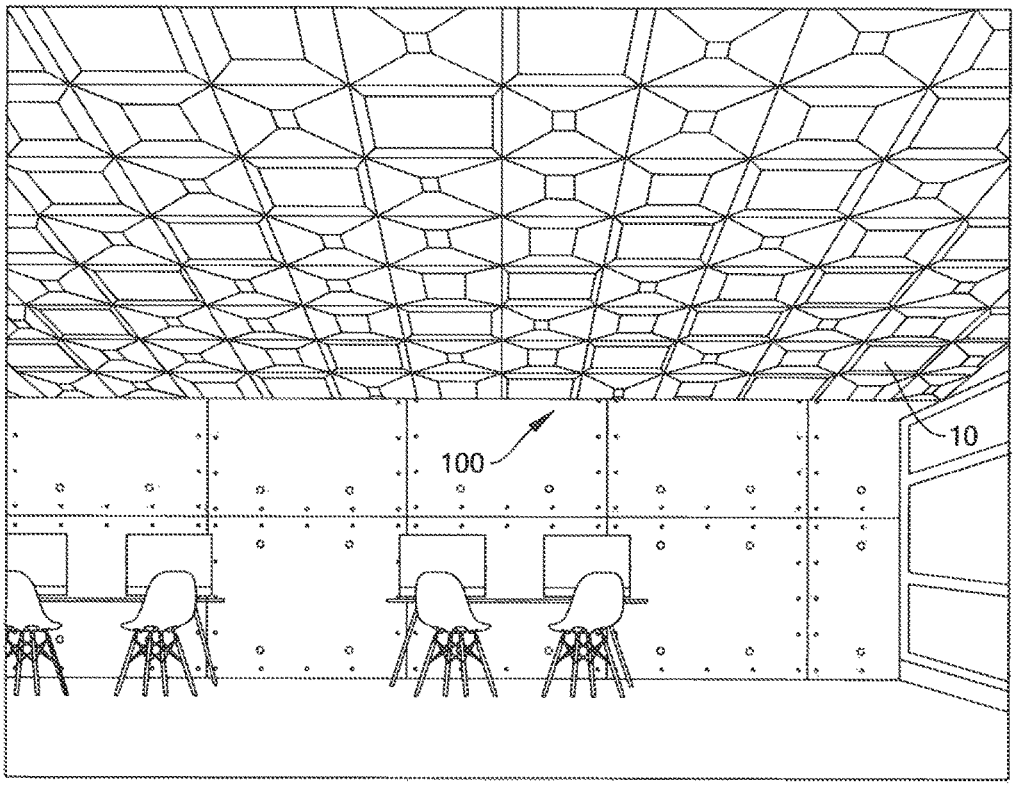
FIGS. 20A and 20B are perspective views of a fluctuating ceiling system installed in a prior art standard drop ceiling in accordance with the present disclosure.
Figure 20B:
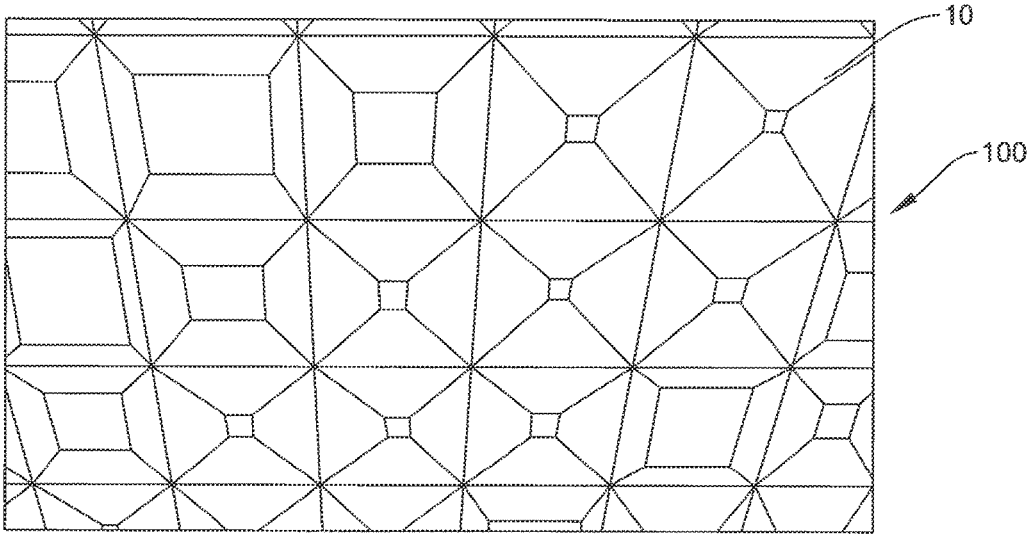

FIGS. 20A and 20B show an alternative embodiment for the ceiling system 100 using the ceiling tiles 10 from the fifth alternative embodiment with each ceiling tile 10 attached to the ceiling structure 14 using the magnetic assemblies 12. FIG. 20A shows the fifth alternative embodiment ceiling system 100 and FIG. 20B shows a close up of the ceiling system 100 for the fourth alternative embodiment.

Accordingly, the ceiling tiles 10 described herein along with other ceiling tiles 10 of different shapes and sizes can be incorporated into various ceiling systems 100 and fall within the scope of the present disclosure.

As described herein, the material used in the preferred embodiment is polyester felt and is 99% recycled. The ceiling tiles 10 in the preferred embodiment are 5 mm thick, with a general t ceiling tile size of 24 inches by 24 inches and between 4 inches and 8 inches from top to bottom. The edge options are exposed felt, and maintenance includes occasional vacuuming to remove particulate matter and air-borne debris or dust. Compressed air can be used to dust off the material in difficult to reach areas and for large assemblies.

The felt comes in numerous colors, including white, cream, light grey, light brown, brown, matte grey, charcoal, black, yellow, mango, orange, red, lavender, lime, green, light blue and dark blue. Of course, the ceiling tiles 10 can be manufactured in many other colors and the present disclosure is not limited to these specifications and colors, as these are merely the specifications and colors for the preferred embodiments and alternative embodiments.

FIG. 21 shows a chart for the acoustic testing standard ASTM C423 for the ceiling tiles 10 in the preferred embodiment. The chart indicates testing on the preferred embodiment and provides the results of the sound absorption coefficient for the ceiling tile 10 at various frequencies. The test arrangement used a +100 mm air layer filled with 50 mm rock wool board. As described herein, the noise reduction coefficient at 500 Hz 98 is 0.76 102, and at 1000 Hz 104 is 1.00 106. Further, the ceiling tiles 10 are fire rated as UL tested ASTM E-84: Class A.

Figure 22:
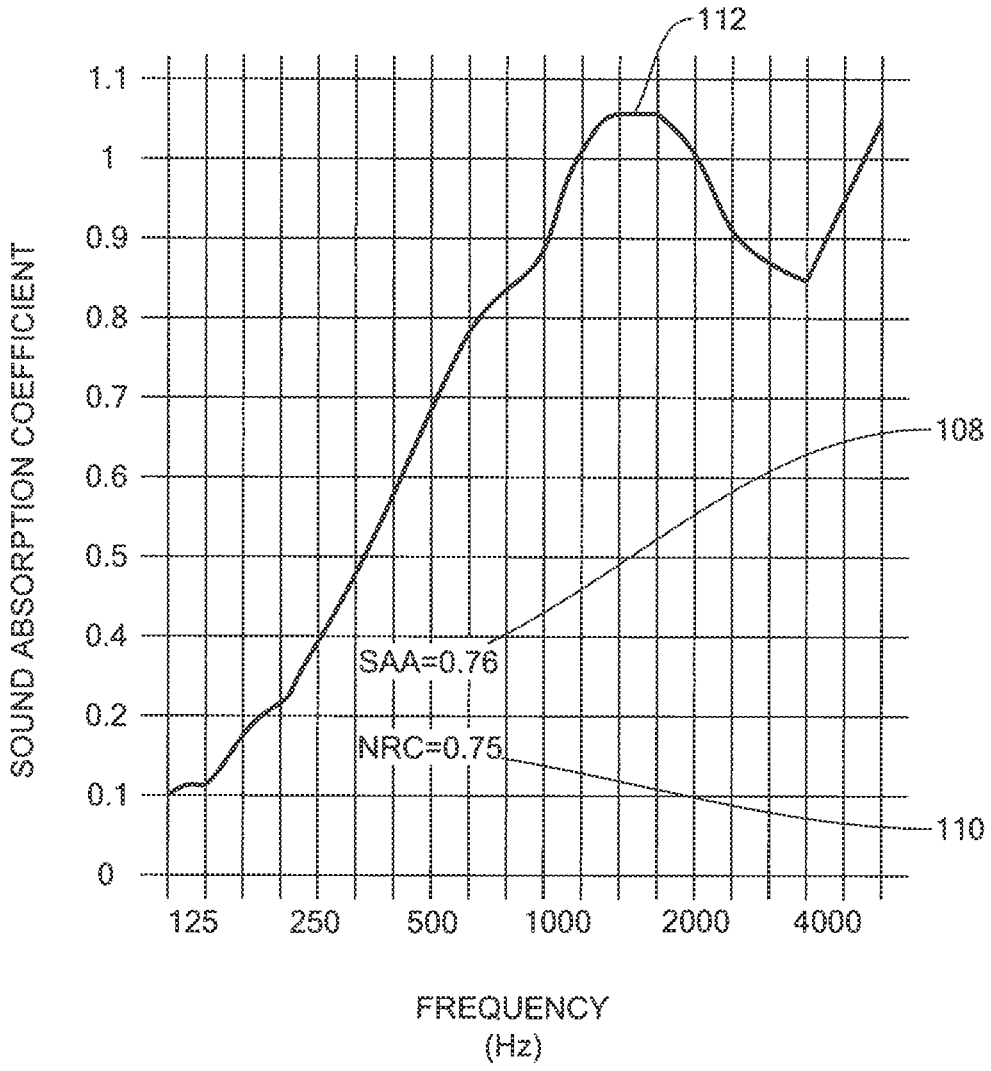
FIG. 22 is a graph of acoustic testing in accordance with ASTM C423 of the ceiling baffles in accordance with the present disclosure.

FIG. 22 shows the graph 112 of the sound absorption coefficient against frequency for the same test, with the sound absorption average (SAA) 108 of 0.76, and the noise reduction coefficient (NRC) 110 of 0.75.

Reference throughout the specification to "various embodiments," "some embodiments," "one embodiment," or "an embodiment", or the like, means that a particular feature, structure, or characteristic described in connection with the embodiment is included in at least one embodiment. Thus, appearances of the phrases "in various embodiments," "in some embodiments," "in one embodiment," or "in an embodiment", or the like, in places throughout the specification are not necessarily all referring to the same embodiment.

Further, the particular features, structures, or characteristics may be combined in any suitable manner in one or more embodiments. Thus, the particular features, structures, or characteristics illustrated or described in connection with one embodiment may be combined, in whole or in part, with the features structures, or characteristics of one or more other embodiments without limitation given that such combination is not illogical or non-functional. Although numerous embodiments of this invention have been described above with a certain degree of particularity, those skilled in the art could make numerous alterations to the disclosed embodiments without departing from the spirit or scope of this disclosure.

All directional references (e.g., plus, minus, upper, lower, upward, downward, left, right, leftward, rightward, top, bottom, above, below, vertical, horizontal, clockwise, and counterclockwise) are only used for identification purposes to aid the reader's understanding of the present disclosure, and do not create limitations, particularly as to the position, orientation, or use of the any aspect of the disclosure.

As used herein, the phrased "configured to," "configured for," and similar phrases indicate that the subject device, apparatus, or system is designed and/or constructed (e.g., through appropriate hardware, software, and/or components) to fulfill one or more specific object purposes, not that the subject device, apparatus, or system is merely capable of performing the object purpose. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other. It is intended that all matter contained in the above description or shown in the accompanying drawings shall be interpreted as illustrative only and not limiting. Changes in detail or structure may be made without departing from the spirit of the invention as defined in the appended claims.

Any patent, publication, or other disclosure material, in whole or in part, that is said to be incorporated by reference herein is incorporated herein only to the extent that the incorporated materials does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein will only be incorporated to the extent that no conflict arises between that incorporated material and the existing disclosure material.

What is claimed is:

1. A dynamic acoustic ceiling system for reducing unwanted noise or room acoustics, comprising:

an acoustic ceiling tile, said acoustic ceiling tile having a first location on a side of said acoustic ceiling tile, said acoustic ceiling tile having a second location on a side of said acoustic ceiling tile;

a magnetic assembly, said magnetic assembly comprising a magnet retaining clip and a magnet, said magnet retaining clip configured to accept and securely hold said magnet, said magnet retaining clip further configured to be attached to said first location on said acoustic ceiling tile;

said magnet retaining clip further configured to be temporarily removed from said first location on the side of said acoustic ceiling tile, and reattached to a said second location on said ceiling tile, such that a plurality of said acoustic ceiling tiles can be attached to a ceiling structure using the magnet secured by said magnet retaining clip without the need for any tools or attachment devices;

wherein, once said plurality of acoustic ceiling tiles has been attached to said ceiling structure, the plurality of acoustic ceiling tiles provides an aesthetically pleasing design along with a reduction in unwanted noise or room acoustics.

2. The dynamic acoustic ceiling system of claim 1, wherein said acoustic ceiling tile is made of PET Felt material.

3. The dynamic acoustic ceiling system of claim 1, wherein each of said plurality of acoustic ceiling tiles is identical to each other of said plurality of acoustic ceiling tiles.

4. The dynamic acoustic ceiling system of claim 1, wherein each of said plurality of acoustic ceiling tiles is different from some of the other of said plurality of acoustic ceiling tiles.

5. The dynamic acoustic ceiling system of claim 1, wherein said magnet retaining clip is made of steel.

6. The dynamic acoustic ceiling system of claim 1, wherein said magnet retaining clip comprises a magnet retaining tab to accept and securely hold said magnet.

7. The dynamic acoustic ceiling system of claim 1, wherein said magnet retaining clip comprises a plurality of front side and back side retaining tabs for attachment to said first location on the side of said acoustic ceiling tile.

8. An acoustic ceiling tile for reducing unwanted noise or room acoustics, comprising:

a first location on a side of said acoustic ceiling tile;

a second location on a side of said acoustic ceiling tile;

a magnetic assembly, said magnetic assembly comprising a magnet retaining clip and a magnet, said magnet retaining clip configured to accept and securely hold said magnet, said magnet retaining clip further configured to be attached to said first location on said acoustic ceiling tile;

said magnet retaining clip further configured to be temporarily removed from said first location on the side of said acoustic ceiling tile, and reattached to said second location on said ceiling tile, such that said acoustic ceiling tile can be attached to a ceiling structure using the magnet secured by said magnet retaining clip without the need for any tools or attachment devices;

wherein, once said acoustic ceiling tile has been attached to said ceiling structure, the acoustic ceiling tile provides a reduction in unwanted noise or room acoustics.

9. The acoustic ceiling tile of claim 8, wherein said acoustic ceiling tile is made of PET Felt material.

10. The acoustic ceiling tile of claim 8, wherein said magnet retaining clip is made of steel.

11. The acoustic ceiling tile of claim 8, wherein said magnet retaining clip comprises a magnet retaining tab to accept and securely hold said magnet.

12. The acoustic ceiling tile of claim 8, wherein said magnet retaining clip comprises a plurality of front side retaining tabs for attachment to said first location on the side of said acoustic ceiling tile.

13. The acoustic ceiling tile of claim 12, wherein said magnet retaining clip comprises a plurality of back side retaining tabs for attachment to said first location on the side of said acoustic ceiling tile.

14. The acoustic ceiling tile of claim 13, wherein said magnet retaining clip can be removed from said first location on the side of said acoustic ceiling tile by pulling the front side retaining tabs away from the back side retaining tabs and removing said magnet retaining clip from said first location on the side of said acoustic ceiling tile.

15. The acoustic ceiling tile of claim 14, wherein said magnet retaining clip can be reattached to said second location on the side of said acoustic ceiling tile by sliding said magnet retaining clip over said second location on the side of said acoustic ceiling tile.

* * * * *